US011233305B2

(12) United States Patent
Tsumuraya et al.

(10) Patent No.: US 11,233,305 B2
(45) Date of Patent: Jan. 25, 2022

(54) WAVEGUIDE COMPRISING A CONDUCTOR LAYER FORMED ON A RESIN TUBE INCLUDING FITTINGS HELD BY THE RESIN TUBE AND A METHOD FOR FORMING THE WAVEGUIDE

(71) Applicant: Molex, LLC, Lisle, IL (US)

(72) Inventors: Tetsunori Tsumuraya, Yamato (JP); Hideo Nagasawa, Yamato (JP)

(73) Assignee: Molex, LLC, Lisle, IL (US)

( * ) Notice: Subject to any disclaimer, the term of this patent is extended or adjusted under 35 U.S.C. 154(b) by 14 days.

(21) Appl. No.: 16/794,242

(22) Filed: Feb. 19, 2020

(65) Prior Publication Data

US 2020/0287263 A1 Sep. 10, 2020

(30) Foreign Application Priority Data

Mar. 4, 2019 (JP) ..... JP2019-038647

(51) Int. Cl.
*H01P 3/12* (2006.01)
*H01P 11/00* (2006.01)

(52) U.S. Cl.
CPC ..... *H01P 3/12* (2013.01); *H01P 11/002* (2013.01)

(58) Field of Classification Search
CPC ..... H01P 3/12; H01P 3/121; H01P 11/002
USPC ..... 333/239
See application file for complete search history.

(56) References Cited

U.S. PATENT DOCUMENTS

| | | | | |
|---|---|---|---|---|
| 4,020,875 | A * | 5/1977 | Akiba | H01P 3/12 138/128 |
| 5,729,646 | A | 3/1998 | Miyagi et al. | |
| 2009/0007415 | A1 | 1/2009 | Hongo et al. | |
| 2016/0336654 | A1 | 11/2016 | Aoki et al. | |

FOREIGN PATENT DOCUMENTS

| | | | |
|---|---|---|---|
| CN | 101426343 | A | 5/2009 |
| CN | 206340651 | U | 7/2017 |
| CN | 107925145 | A | 4/2018 |
| CN | 108123195 | A | 6/2018 |
| CN | 108780936 | A | 11/2018 |
| JP | 2001053509 | A | 2/2001 |
| JP | 4011240 | B2 | 11/2007 |
| JP | 2010-252092 | A | 11/2010 |
| WO | 2018063342 | A1 | 4/2018 |

(Continued)

OTHER PUBLICATIONS

Zhang et al., "Research on Microwave 3D Multi-chip Module Technology Based on Resin Encapsulation", Retrieved from Internet URL : https://www.cnki.com.cn/Article/CJFDTotal-XDLD201312016.htm, Jun. 18, 2021, 01 Page. (Abstract).

(Continued)

*Primary Examiner* — Benny T Lee

(57) ABSTRACT

A waveguide includes a tubular resin portion formed of resin, a conductor layer formed on an inner surface of the resin portion, and a fitting held by the resin portion. The fitting includes an inner exposed portion having an exposed surface that is not covered with a resin that is a material for the resin portion. The conductor layer covers the exposed surface of the inner exposed portion and is in contact with the inner exposed portion.

9 Claims, 18 Drawing Sheets

(56) References Cited

FOREIGN PATENT DOCUMENTS

WO 2018106471 A1 6/2018

OTHER PUBLICATIONS

Office Action received for CN Application No. 202010139239.2, dated Apr. 2, 2021, 12 Pages (6 Pages of English Translation and 6 Pages of Official notification).
Notice of Allowance received for CN Application No. 202010139239.2, dated Sep. 3, 2021, 07 Pages (03 Pages of English Translation and 04 Pages of Official notification).

* cited by examiner

WAVEGUIDE COMPRISING A CONDUCTOR LAYER FORMED ON A RESIN TUBE INCLUDING FITTINGS HELD BY THE RESIN TUBE AND A METHOD FOR FORMING THE WAVEGUIDE

RELATED APPLICATION

This application claims priority to Japanese Application Serial No. 2019-038647, filed on Mar. 4, 2019, which is incorporated by reference in its entirety.

TECHNICAL FIELD

The present disclosure relates to a waveguide.

BACKGROUND ART

As a waveguide for transmitting radio waves such as microwaves and millimeter waves, a metal waveguide, a waveguide in which metal plating is formed on an inner surface of a resin tube, and the like have been known. For example, Patent Documents 1 and 2 disclose a waveguide having a conductor layer that is metal plating on an inner surface of a resin tube. By using a resin as the material for the tube, the waveguide can be made lighter and less expensive.

PATENT DOCUMENT

Patent Document 1: Japanese Unexamined Patent Application Publication No. 2001-053509

Patent Document 2: Japanese Unexamined Patent Application Publication No. 2010-252092

SUMMARY

However, it is not easy to form a conductor layer on the inner surface of the resin tube. For example, when the conductor layer is formed of plating, there are problems such that it takes too long to form the plating having a required thickness on the inner surface of the waveguide, and the thickness of the plating becomes uneven.

An example of a waveguide proposed in the present disclosure includes a tubular resin portion made of a resin, a conductor layer formed on an inner surface of the resin portion, and at least one fitting held by the resin portion. The at least one fitting has at least one exposed surface that is not covered with the resin and at least one energizing portion electrically connected to the exposed surface. The conductor layer covers the at least one exposed surface and is in contact with the at least one exposed surface. The waveguide enables the conductor layer to be easily formed on the inner surface of the resin portion.

An example of a method for manufacturing a waveguide proposed in the present disclosure includes preparing at least one fitting, and forming a resin portion for holding the fitting. In the forming of the resin portion, the fitting is fixed to the resin portion such that an exposed surface that is not covered with a resin of the fitting is located on an inner surface of the resin portion. The example of the manufacturing method further includes: forming a first conductor layer made of an ink or paste of electrically-conductive material on the inner surface of the resin portion, covering the at least one exposed surface with the first conductor layer, and connecting the at least one exposed surface to the first conductor layer; and forming a conductor layer on the inner surface by electrolytic plating using the fitting and the first conductor layer as electrodes. According to this manufacturing method, the conductor layer may be easily formed on the inner surface of the resin portion.

DETAILED DESCRIPTION OF THE PREFERRED EMBODIMENTS

Hereinafter, an example of a waveguide proposed in the present disclosure will be described, where like features are denoted by the same reference labels throughout the specification description. Hereinafter, a waveguide 10 illustrated in FIG. 1 and other drawings will be described as an example of the waveguide proposed in the present disclosure.

Figure 1:
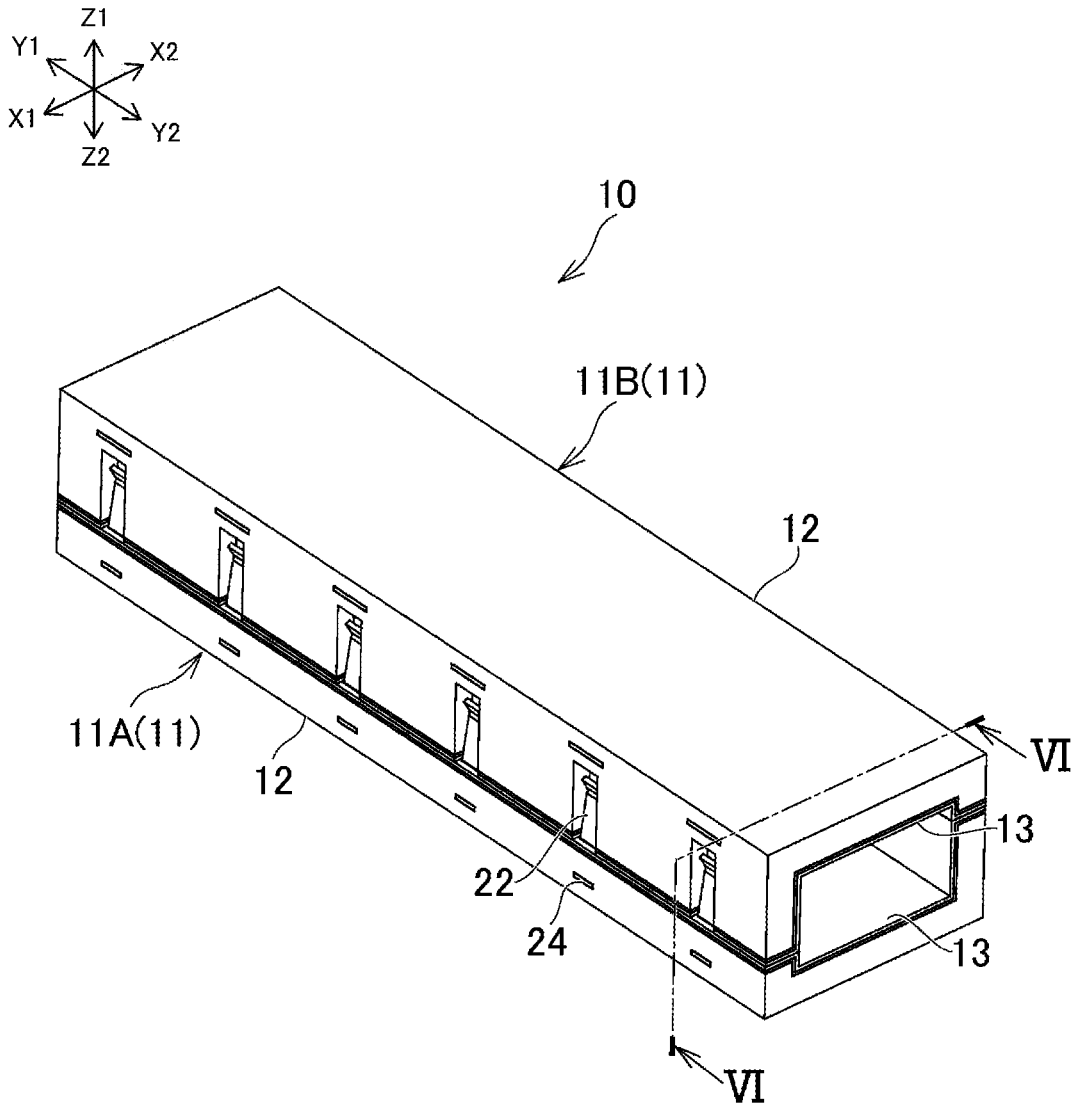
FIG. 1 is a perspective view illustrating one example of a waveguide proposed in the present disclosure.

Moreover, directions indicated by Z1 and Z2 in FIG. 1 are referred to as "upward direction" and "downward direction", respectively. The terms "upward" and "downward" are used to describe the relative positional relationship of members and sections that configure the waveguide 10, and are not intended to limit the orientation of the waveguide 10 during use. The direction indicated by Y1-Y2 in FIG. 1 is referred to as the "extending direction of" the waveguide 10, and the direction indicated by X1-X2 in FIG. 1 is referred to as the "width direction of" the waveguide 10.

The waveguide 10 is used for transmitting high-frequency waves such as millimeter waves or microwaves. In use of the waveguide 10, a plurality of waveguides 10 may be connected to each other in the extending direction. The waveguide 10 is a tube having a rectangular cross-section, for example. The cross-sectional shape of the waveguide 10 may be circular or otherwise shaped. In the example illustrated in FIG. 1 and other drawings, the waveguide 10 linearly extends, but may be curved in an arc shape.

Figure 2:
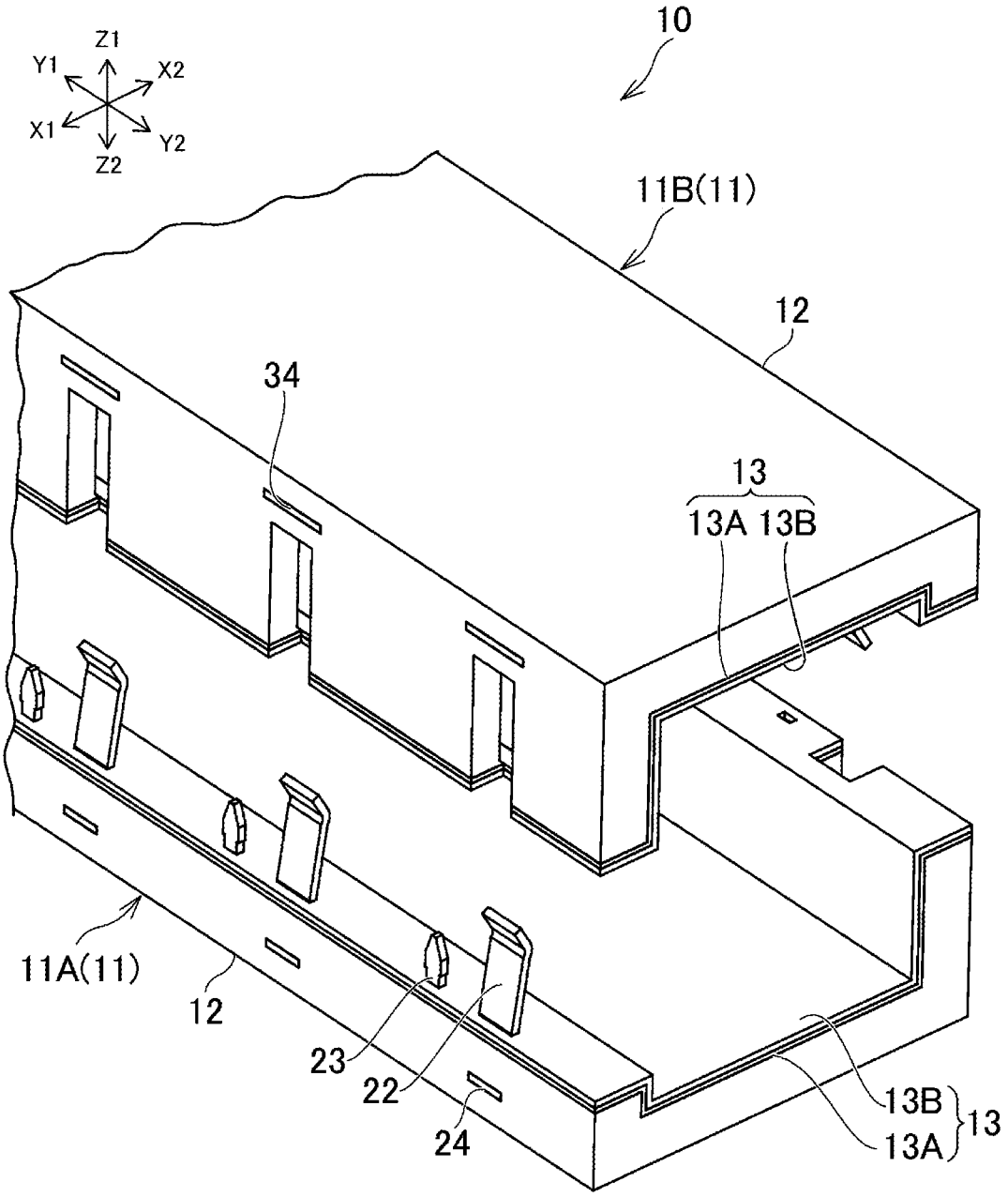
FIG. 2 is an exploded perspective view illustrating the waveguide illustrated in FIG. 1.

As illustrated in FIG. 2, the waveguide 10 may include a first tube member 11A and a second tube member 11B that are combined with each other in the direction orthogonal to the extending direction of the waveguide 10. The first tube member 11A and the second tube member 11B are combined with each other, for example, in the vertical direction to constitute one waveguide 10.

The two tube members 11A and 11B may have the same structure. Additionally, one of the second tube member 11B and the first tube member 11A may be rotated about a straight line extending in the extending direction of the waveguide 10 by 180 degrees with respect to the other tube member. When the two tube members 11A and 11B have the same structure, for example, the first tube member 11A and the second tube member 11B can be manufactured by using the same mold and thus, the waveguide 10 can be made inexpensive. However, the first tube member 11A and the second tube member 11B may have different structures.

Hereinafter, when the first tube member 11A and the second tube member 11B are not distinguished from each other, a reference numeral 11 is assigned to both the tube members 11A and 11B.

Figure 6:
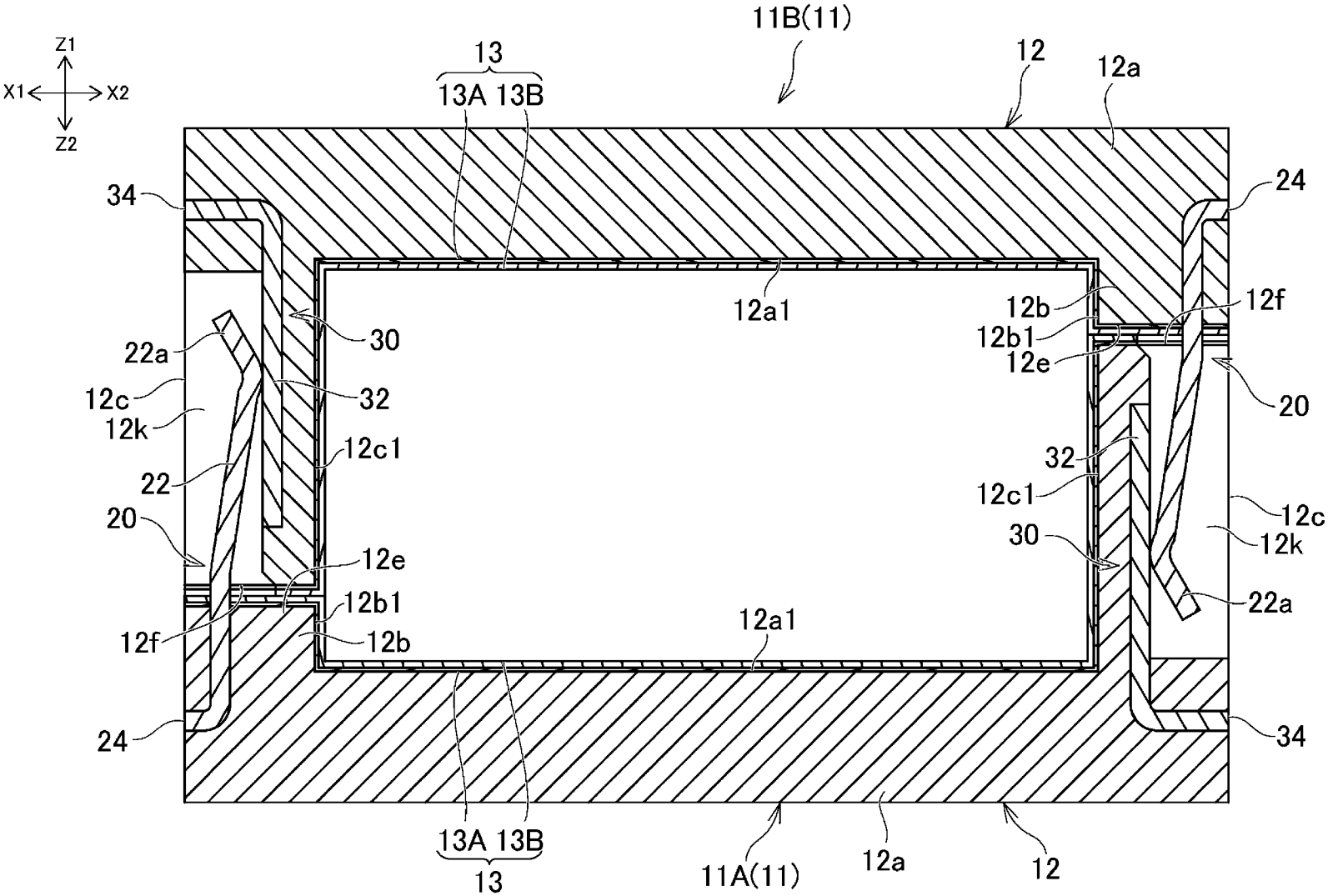
FIG. 6 is a cross-sectional view taken along a line VI-VI illustrated in FIG. 1. This drawing is a view taken by a cutting plane through a connecting portion described below.

As illustrated in FIG. 6, the tube member 11 may include a resin portion 12 made of a resin, and a plurality of fittings 20 and 30 held by the resin portion 12. Examples of the material for the resin portion 12 include plastics such as polycarbonate, ABS resin, polyamide, polypropylene, polybutylene terephthalate, and urea resin. The resin portion 12 of one tube member 11 and the resin portion 12 of the other tube member 11 are combined to form a tubular resin portion. In other words, the resin portion 12 of each tube member 11 constitutes a part of the resin portion of the waveguide 10 (half in the example of the waveguide 10).

Figure 5:
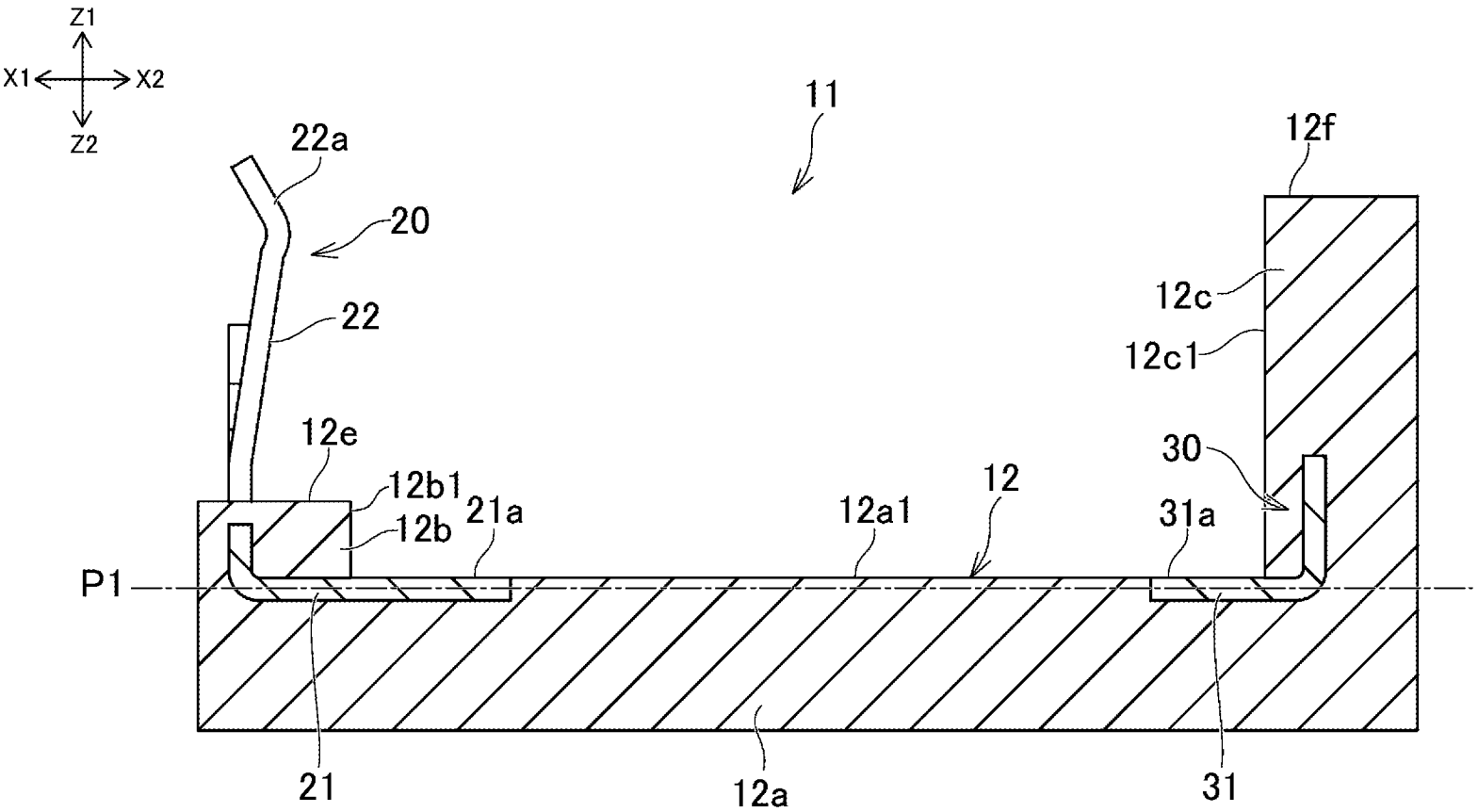
FIG. 5 is a cross sectional view along a line V-V illustrated in FIG. 3. This drawing is a view taken by a cutting plane through an inner exposed portion described below.

As illustrated in FIG. 5, the resin portion 12 may include a bottom portion 12*a* opposed to the opposite tube member 11 in the vertical direction, a first side portion 12*b* located on one edge of the bottom portion 12*a*, and a second side portion 12*c* located on the other edge of the bottom portion 12*a*. The first side portion 12*b* may be shaped like a wall formed along the edge of the bottom portion 12*a*, for example. The second side portion 12*c* may be also shaped like a wall formed along the edge of the bottom portion 12*a*, for example. The height of the second side portion 12*c* and the height of the first side portion 12*b* may be different or the same. In the example of the waveguide 10, the second side portion 12*c* is higher than the first side portion 12*b*. Note that the shape of the resin portion 12 is not limited to the example described here. One of the two side portions 12*b* and 12*c* may not be wall-shaped. In other words, the resin portion 12 may have a substantially L-shaped cross section.

As described above, the waveguide 10 is constituted of the two tube members 11 (that is, the first tube member 11A and the second tube member 11B as illustrated in FIG. 2) that are combined with each other in the vertical direction. The first side portion 12*b* of the first tube member 11A is opposed to the second side portion 12*c* of the second tube member 11B in the vertical direction, and the second side portion 12*c* of the first tube member 11A is opposed to the first side portion 12*b* of the second tube member 11B in the vertical direction.

As illustrated in FIG. 5, the inner surface of the resin portion 12 is a surface that forms the inner side of the waveguide 10, and is formed of an inner surface 12*a*1 of the bottom portion 12*a*, an inner surface 12*b*1 of the first side portion 12*b*, and an inner surface 12*c*1 of the second side portion. When there is only one tube member 11, the space formed by the inner surfaces 12*a*1, 12*b*1, and 12*c*1 is opened upward. Because one side is open, a plating step and a step of applying an electrically-conductive material, which will be described later, may be performed from the open side, improving the workability.

As illustrated in FIG. 6, a conductive conductor layer 13 may be formed on the inner surfaces 12*a*1, 12*b*1, and 12*c*1 of the resin portion 12. The conductor layer 13 may be formed over the entire inner surface of the resin portion 12. The conductor layer 13 is not necessarily formed on the outer surface of the resin portion 12.

The conductor layer 13 may be configured of a plurality of layers. Specifically, the conductor layer 13 may have a first conductor layer 13A as a so-called seed layer formed directly on the inner surfaces 12*a*1, 12*b*1, and 12*c*1 of the resin portion 12, and a second conductor layer 13B formed using the first conductor layer 13A as a cathode electrode for electrolytic plating. The fittings 20 and 30 have respective exposed surfaces 21*a* and 31*a* exposed on the inner surfaces 12*a*1, 12*b*1, and 12*c*1 of the resin portion 12 (see FIG. 6). The exposed surfaces 21*a* and 31*a* are electrically connected to the first conductor layer 13A. In electrolytic plating, a voltage is applied through the fittings 20 and 30, thereby causing the first conductor layer 13A to function as the cathode electrode. The first conductor layer 13A is, for example, a layer formed by applying an ink or paste electrically-conductive material to the inner surfaces 12*a*1, 12*b*1, and 12*c*1 of the resin portion 12. The electrically-conductive material may be ink (or paste) of silver, copper, zinc oxide, or the like, but is not limited thereto. The seed layer may be easily formed by simply applying such ink or paste conductor. The first conductor layer 13A that is the seed layer may be also formed by sputtering or the like. The second conductor layer 13B is a layer formed on the first conductor layer 13A by electrolytic plating, and is, for example, a copper plating layer, a nickel plating layer, or a silver plating layer.

The material of the first conductor layer 13A and the material of the second conductor layer 13B may be different or the same. The first conductor layer 13A and the second conductor layer 13B of the conductor layer 13 do not necessarily have a distinct boundary. The conductor layer 13B may be diffused into the conductor layer 13A, failing to provide a clear boundary. Furthermore, when the same material is used, a single layer may be formed. The conductor layer 13 is not a two-layer structure, and may be configured of three laminated conductor layers that are nickel layers functioning as protective films.

Figure 3:
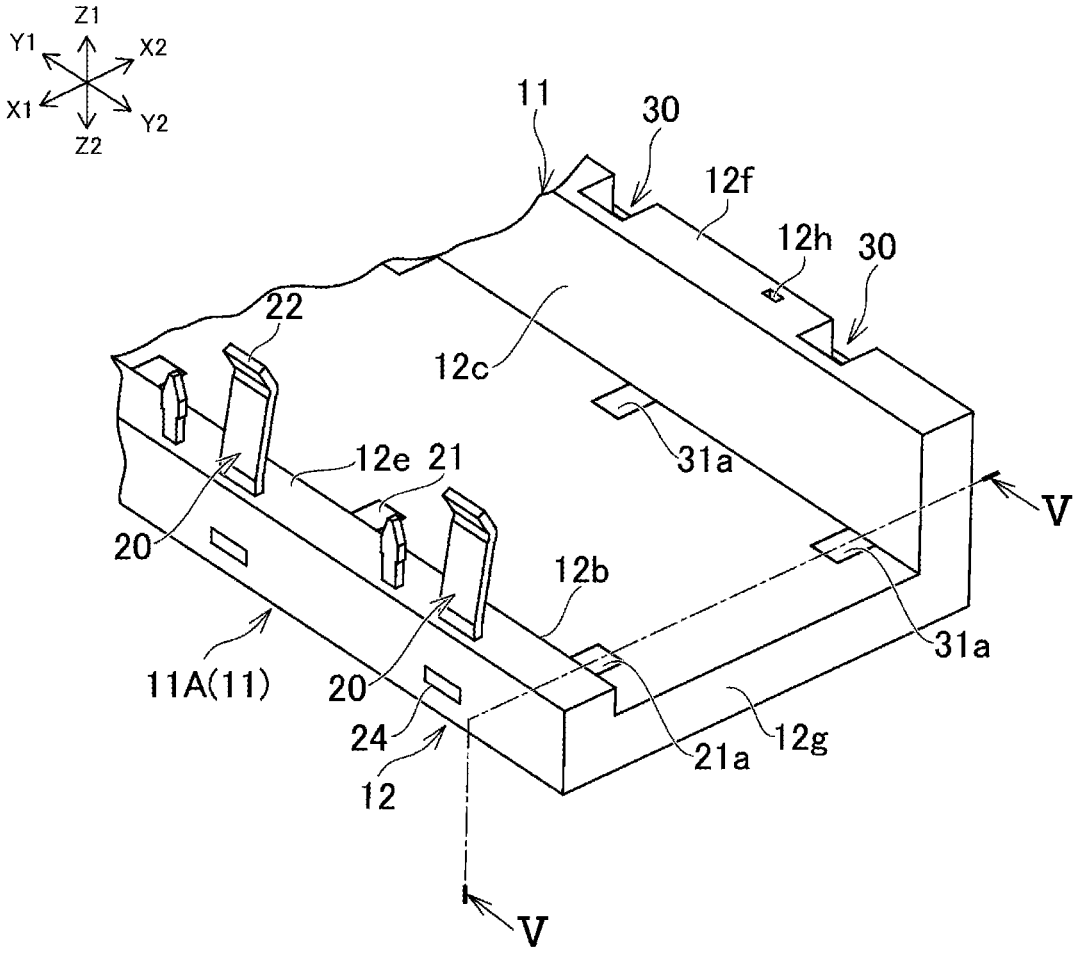
FIG. 3 is a perspective view illustrating one of tube members constituting the waveguide illustrated in FIG. 1. In this drawing, a conductor layer formed on an inner surface of the waveguide is not depicted.
Figure 4A:
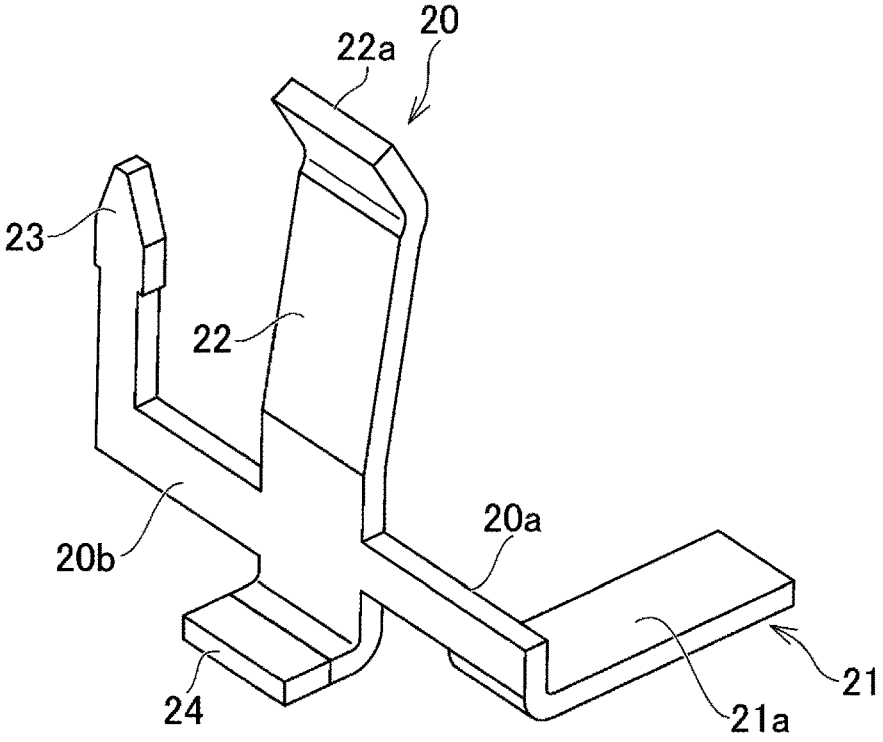
FIG. 4A is a perspective view illustrating a first fitting.
Figure 4B:
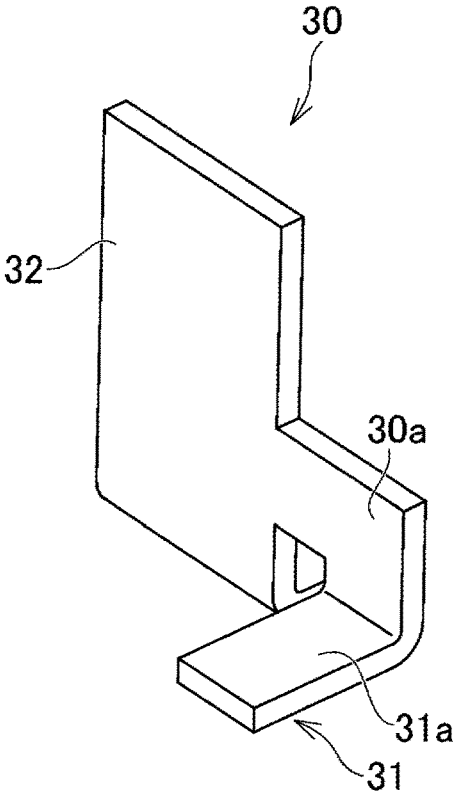
FIG. 4B is a perspective view illustrating a second fitting.

As illustrated in FIG. 3, FIG. 4A, and FIG. 4B, the tube member 11 (FIG. 3) includes two types of fittings 20 (FIGS. 3 and 4A) and 30 (FIGS. 3 and 4B) having different shapes. The fittings 20 and 30 each may be formed by pressing a metal plate. The fittings 20 and 30 may be formed of a thin metal plate having a high electrical conductivity, and may be connected to the conductor layer 13. The fittings 20 and 30 each are a thin plate made of copper or copper alloy, for example. The fittings 20 and 30 are fixed to the resin portion 12 (FIG. 3) by, for example, insert molding. The fittings 20 and 30 may be press-fitted into respective holes formed in the resin portion 12 rather than insert-molded, to be secured to the resin portion 12.

As illustrated in FIG. 4A, in the first fitting 20, a first inner exposed portion 21, a first connecting portion 22, an engaging portion 23, and a first energizing portion 24 are integrated. In other words, the first fitting 20 includes a portion 20*b* that connects a base of the first connecting portion 22 to a base of the engaging portion 23, and a portion 20*a* that connects the base of the first connecting portion 22 to a base of the first inner exposed portion 21.

The first energizing portion 24 is bent from the base of the first connecting portion 22 and is formed outward. Portions other than the first inner exposed portion 21, the first connecting portion 22, and the engaging portion 23 may be embedded in the resin portion 12. For example, the portions 20*a* and 20*b* are embedded in the resin portion 12. As a result, the first fitting 20 is firmly fixed to the resin portion 12. The first energizing portion 24 is coupled to a coupling portion 29 with extending portions 28 in the state where the extending portions 28 have not yet been cut in the manufacturing process of the tube member 11, such that the plurality of first fittings 20 are disposed in the extending direction of the resin portion 12 (see FIG. 7B).

As illustrated in FIG. 4B, the second fitting 30 may include a second inner exposed portion 31, a second connecting portion 32, and a second energizing portion 34 (see FIG. 6). The second inner exposed portion 31, the second connecting portion 32, and the second energizing portion 34 are connected to each other. In other words, the second fitting 30 has a portion 30*a* that connects a base of the second connecting portion 32 to a base of the second inner exposed portion 31, and the second energizing portion 34 is formed from the base of the second connecting portion 32 toward the outer surface. Portions other than the second inner exposed portion 31 and the second connecting portion 32 are embedded in the resin portion 12. For example, the portion 30*a* may be embedded in the resin portion 12. As a result, the second fitting 30 is firmly fixed to the resin portion 12. Similar to the first fitting 20, the second energizing portion 34 is coupled to a coupling portion 39 with extending portions 38 in the state where the extending portions 38 have not yet been cut in the manufacturing process of the tube member 11, such that the plurality of second fittings 30 are disposed in the extending direction of the resin portion 12 (see FIG. 7B).

As illustrated in FIGS. 4A, 4B, and 5, the first inner exposed portion 21 of the first fitting 20 as illustrated in FIGS. 4A and 5 and the second inner exposed portion 31 of the second fitting 30 as illustrated in FIGS. 4B and 5 have the first exposed surface 21*a* as illustrated in FIGS. 4A and 5 and the second exposed surface 31*a* as illustrated in FIGS. 4B and 5, respectively, which are located on the side of the inner surface of the resin portion 12 (FIG. 5) and not covered with the resin material. That is, in the state where the conductor layer 13 is not formed, the first exposed surface 21*a* and the second exposed surface 31*a* are exposed on the surface of the resin portion 12, i.e., the inner surface 12*a*1 of the bottom portion 12*a* as illustrated in FIG. 5. The first exposed surface 21*a* and the second exposed surface 31*a* are covered with the conductor layer 13 (more specifically, the first conductor layer 13A) and are in contact with the conductor layer 13. This structure may facilitate manufacturing of the waveguide 10. For example, when the second conductor layer 13B is formed by the electrolytic plating step, the first fitting 20 and the first conductor layer 13A can be used as cathode electrodes for electrolytic plating. Therefore, time required to form the second conductor layer 13B may be reduced. In other words, the conductor layer 13 required on the inner surface of the waveguide 10 may be efficiently formed.

In particular, the exposed surfaces 21*a* and 31*a* of the inner exposed portions 21 (FIGS. 4A and 5) and 31 (FIGS. 4B and 5) may be flush with the inner surface of the resin portion 12 (inner surface 12*a*1 of the bottom portion 12*a*) (these surfaces may be located on a common plane P1 that is the same plane). With this structure, there is no step around the inner exposed portions 21 and 31, making the inner surface smooth to easily form the conductor layer 13 having a uniform thickness.

As illustrated in FIG. 5, a width (width in the X1-X2 direction) of the inner surface 12*a*1 of the bottom portion 12*a* is larger than the width of the inner surfaces 12*b*1 and 12*c*1 of the side portions 12*b* and 12*c* (that is, the width in the Z1-Z2 height direction). Therefore, by providing the first inner exposed portion 21 and the second inner exposed portion 31 on the inner surface 12*a*1 of the bottom portion 12*a*, the area of the first exposed surface 21*a* and the second exposed surface 31*a* may be easily ensured.

As illustrated in FIG. 3, the waveguide 10 includes the plurality of first fittings 20 and the second fittings 30 that are aligned in the extending direction of the waveguide 10. As such, the plurality of first inner exposed portions 21 and the plurality of second inner exposed portions 31 are aligned in the extending direction of the waveguide 10. Given that each of the first fittings 20 and the second fittings 30 are a cathode electrode in this arrangement, when the second conductor layer 13B is formed in the electrolytic plating step, the electric potential of the first conductor layer 13A may be prevented from becoming uneven in the extending direction of the waveguide 10, to reduce the unevenness of the thickness of the second conductor layer 13B, and in turn, the thickness of the conductor layer 13.

Further, unlike the example of the waveguide 10, the plurality of first inner exposed portions 21 or the plurality of second inner exposed portions 31 may be formed in one fitting. In other words, two or more adjacent fittings may be connected to each other.

As illustrated in FIG. 5, the first inner exposed portion 21 is separated from the second inner exposed portion 31 in the width direction (X1-X2 direction) of the waveguide 10. With this arrangement of the inner exposed portions 21 and 31, when the second conductor layer 13B is formed in the electrolytic plating step, the electric potential of the first conductor layer 13A may be prevented from becoming uneven in the width direction of the waveguide 10, to reduce the unevenness of the thickness of the second conductor layer 13B, and in turn, the thickness of the conductor layer 13. The first inner exposed portion 21 and the second inner exposed portion 31 may be disposed symmetrically with respect to a plane passing through the center of the waveguide 10 in the width direction (X1-X2 direction), for example.

The positions of the first inner exposed portion 21 and the second inner exposed portion 31 are not limited to the example of the waveguide 10. The first inner exposed portion 21 may be located on the inner surface of the side portion 12*b* (the surface opposed to the inner side of the waveguide 10), or may be located on both the inner surface of the side portion 12*b* and the inner surface of the bottom portion 12*a*. As yet another example, the first inner exposed portion 21 may be located on an opposed surface 12*e* of the side portion 12*b* (see FIG. 3). Here, the opposed surface 12*e* is a surface that faces in the direction in which the two tube members 11 are combined with each other. Also, the second inner exposed portion 31 may be located on the inner surface of the side portion 12*c* (the surface opposed to the inner side of the waveguide 10), or may be located on both the inner surface of the side portion 12*c* and the inner surface of the bottom portion 12*a*. As yet another example, the second inner exposed portion 31 may be located at an opposed surface 12*f* to the side portion 12*b* (see FIG. 3). Here, the opposed surface 12*f* is a surface that faces in the direction in which the two tube members 11 are combined with each other.

Unlike the example of the waveguide 10, only one of the two types of fittings 20 and 30 may have the inner exposed portion. In this case, the exposed surface of the inner exposed portion may be positioned at or near the center of the waveguide 10 in the width direction (X1-X2 direction). That is, the exposed surface of the inner exposed portion may be positioned to intersect a plane passing through the center of the waveguide 10 in the width direction.

The first fitting 20 and the second fitting 30 each may be formed of a metal plate. In other words, each of the first fitting 20 and the second fitting 30 may be formed by pressing a metal plate. The inner exposed surfaces 21*a* and 31*a* of the inner exposed portions 21 and 31 each may be a part of one surface of the metal plate. This makes it easier to ensure the area of the inner exposed portions 21 and 31, for example, as compared to the case where end surfaces of the metal plate (surface corresponding to the thickness of the metal plate) are used as the inner exposed portions 21 and 31.

The structures of the inner exposed portions 21 and 31 and the resin portion 12 are not limited to the example illustrated in FIG. 5. For example, the inner exposed portions 21 and 31 may be located within the resin portion 12. Additionally, in the state where a hole is formed in the resin portion 12 and the conductor layer 13 is not formed, the first inner exposed portion 21 may be exposed toward the inside of the resin portion 12 (toward the inside of the waveguide 10) through the hole.

As illustrated in FIG. 6, the first fitting 20 has the first energizing portion 24, and the second fitting 30 may have the second energizing portion 34. The energizing portions 24 and 34 are electrically connected to the inner exposed surfaces 21*a* and 31*a*, respectively. When electrolytic plating is performed, a voltage is applied to the fittings 20 and 30 and the first conductor layer 13A through the energizing portion 24 and 34, and the fittings and the first conductor layer are used as cathode electrodes. The energizing portions 24 and 34 are exposed on the outer surface of the resin portion 12 (the surface opposed to the outside of the waveguide 10), and are connected to the extending portions 28 and 38, respectively, in the state where the extending portion 28 (see FIG. 7B) has not yet been cut in the manufacturing process of the tube member 11. In the manufacturing process of the tube member 11, the extending portions 28 and 38 extend from the resin portion 12. The plurality of the extending portions 28 and 38 are continuous with coupling portions 29 and 39, respectively.

In the manufacturing process of the waveguide 10, after the end of electrolytic plating, the connection between the extending portions 28 and the coupling portion 29, and the connection between the extending portions 38 and the coupling portion 39 are disconnected.

Note that the positions of the energizing portions 24 and 34 are not limited to the example of the waveguide 10. For example, the energizing portions 24 and 34 may be located on the opposed surface 12*f* of the resin portion 12 in the extending direction of the waveguide 10. As yet another example, the energizing portions 24 and 34 may be located on the outer surface (lower surface in FIG. 6) of the bottom portion 12*a*.

In the example of the waveguide 10, each of the plurality of first fittings 20 includes the first energizing portion 24. In other words, one first inner exposed portion 21 is provided with one first energizing portion 24. Similarly, each of the plurality of second fittings 30 includes the second energizing portion 34. In other words, one second inner exposed portion 31 is provided with one second energizing portion 34.

The structures of the fittings 20 and 30 are not limited to this configuration. For example, the plurality of fittings 20 may be connected to each other and formed from a metal plate, and only one first energizing portion 24 may be provided for the plurality of first inner exposed portions 21, the plurality of first connecting portions 22, and the plurality of engaging portions 23. Similarly, the plurality of fittings 30 may be connected to each other and formed from a metal plate, and only one first energizing portion 34 may be provided for the plurality of second inner exposed portions 31 and the plurality of second connecting portions 32.

As illustrated in FIG. 6, the first connecting portion 22 of the first fitting 20 may protrude from the opposed surface 12*e* to the first side portion 12*b* of one tube member 11 toward the other tube member 11. The first connecting portion 22 may be elastically deformable in the width direction (X1-X2 direction) of the waveguide 10. The first connecting portion 22 is shaped like a leaf spring, for example. That is, the first connecting portion 22 diagonally extends from the opposed surface 12*e* of the first side portion 12*b* toward the inside of the waveguide 10 in the width direction (X1-X2 direction). The end portion 22*a* of the first connecting portion 22 may be inclined toward the outside in the width direction (X1-X2 direction) of the waveguide 10. Meanwhile, the second connecting portion 32 of the second fitting 30 is formed along the outer surface of the second side portion 12*c* and is exposed toward the outside in the width direction (X1-X2 direction) of the waveguide 10. A groove 12*k* may be formed in the second side portion 12*c* of the resin portion 12. The second connecting portion 32 may be disposed in the groove 12*k*.

As described above, in the example of the waveguide 10, the two tube members 11 have the same structure. Thus, as illustrated in FIG. 6, in the state where the first tube member 11A and the second tube member 11B are combined with each other in the vertical direction, the second connecting portion 32 of the other tube member 11 may be positioned on the inner side the first connecting portion 22 of one tube member 11, such that both are in direct contact. This may electrically connect the first fitting 20 of the first tube member 11A to the second fitting 30 of the second tube member 11B, and the second fitting 30 of the first tube member 11A to the first fitting 20 of the second tube member 11B.

As illustrated in FIG. 6, in each of the tube members 11, the first connecting portion 22 of the first fitting 20 is separated from the second connecting portion 32 of the second fitting 30 in the width direction (X1-X2 direction) of the waveguide 10. In other words, in each of the tube members 11, the first connecting portion 22 of the first fitting 20 is located on one side portion 12*b*, and the second connecting portion 32 of the second fitting 30 is located on the other side portion 12*c*. Thus, the first fitting 20 of the first tube member 11A is connected to the second fitting 30 of the second tube member 11B at one side portion (12*b* or 12*c*), and the second fitting 30 of the first tube member 11A is connected to the first fitting 20 of the second tube member 11B at the other side portion (12*b* or 12*c*). With this structure, since the conductor layer 13 of the first tube member 11A and the conductor layer 13 of the second tube member 11B are electrically continuous to form an annular conductor layer, for example, as compared to the structure in which the two fittings 20 and 30 are connected to each other at only one side portion; an offset between the electric potential of the conductor layer 13 formed on the first tube member 11A and the electric potential of the conductor layer 13 formed on the second tube member 11B may be reduced more effectively.

In each of the two tube members 11, the plurality of first fittings 20 are aligned in the extending direction of the waveguide 10, and the plurality of second fittings 30 are aligned in the extending direction of the waveguide 10. Thus, the connecting portions 22 and 32 are also disposed in the extending direction of the waveguide 10. With this structure, the offset between the electric potential of the conductor layer 13 formed on one tube members 11 and the electric potential of the conductor layer 13 formed on the other tube member 11 can be reduced more effectively across the extending direction of the waveguide 10.

Note that the connecting structures of the fittings included in the two tube members 11 are not limited to the example of the waveguide 10. For example, one first fitting 20 may be provided with the plurality of first connecting portions 22. Similarly, one second fitting 30 may be provided with the plurality of second connecting portions 32. As yet another example, some of the plurality of first fittings 20 of the one tube member 11 are not necessarily connected to the respective second fittings 30 of the other tube member 11.

As illustrated in FIG. 6, the conductor layer 13 may be formed not only on the inner surface of the resin portion 12, but also on the opposed surface 12*e* of the first side portion 12*b* and the opposed surface 12*f* of the second side portion 12*c*. As described above, the opposed surfaces 12*e* and 12*f* are surfaces opposed in the direction in which the two tube members 11 are combined with each other (the vertical direction in the example of the waveguide 10). With this structure, when two tube members 11 are combined with each other, the conductor layer 13 formed on the opposed surfaces 12*e* and 12*f* of one tube member 11 is in contact with the conductor layer 13 formed on the opposed surface 12*e* and 12*f* of the other tube member 11. As a result, the offset between the electric potential of the conductor layer 13 formed on one of the tube members 11 and the electric potential of the conductor layer 13 formed on the other tube member 11 may be reduced more effectively.

As illustrated in FIG. 3, the tube member 11 may include an engaged portion 12*h* and the engaging portion 23. The engaging portion 23 of one tube members 11 may engage with the engaged portion 12*h* of the other tube member 11 to fix the two tube members 11. With this structure, the assembling operation of the two tube members 11 may be facilitated.

As illustrated in FIG. 3 and FIG. 4A, the engaging portion 23 is formed, for example, in the first fitting 30. The engaging portion 23 protrudes from the opposed surface 12*e* of the first side portion 12*b* in the direction in which the two tube members 11 are combined with each other. Meanwhile, the engaged portion 12*h* is formed on the second side portion 12*c* of the resin portion 12. Specifically, the engaged portion 12*h* is a hole formed in the opposed surface 12*f* of the second side portion 12*c*. The engaging portion 23 and the engaged portion 12*h* of one tube members 11 mate with the engaged portion 12*h* and the engaging portion 23 of the other tube member 11. This secures the two tube members 11 in the combined state. A claw that hooks on the inner surface of the engaged portion 12*h* may be formed on the outer surface of the engaging portion 23.

The fixing structure of the two tube members 11 is not limited to the example of the waveguide 10. For example, the engaging portion 23 may be formed in the resin portion 12 instead of the first fitting 20. In other words, the resin portion 12 of one tube member 11 and the resin portion 12 of the other tube member 11 may be engaged with and be fixed to each other. In another example, the engaged portion 12*h* may be formed in the second fitting 30 instead of the resin portion 12. In other words, the first fitting 20 of one tube member 11 and the second fitting 30 of the other tube member 11 may engage with each other.

Figure 7A:
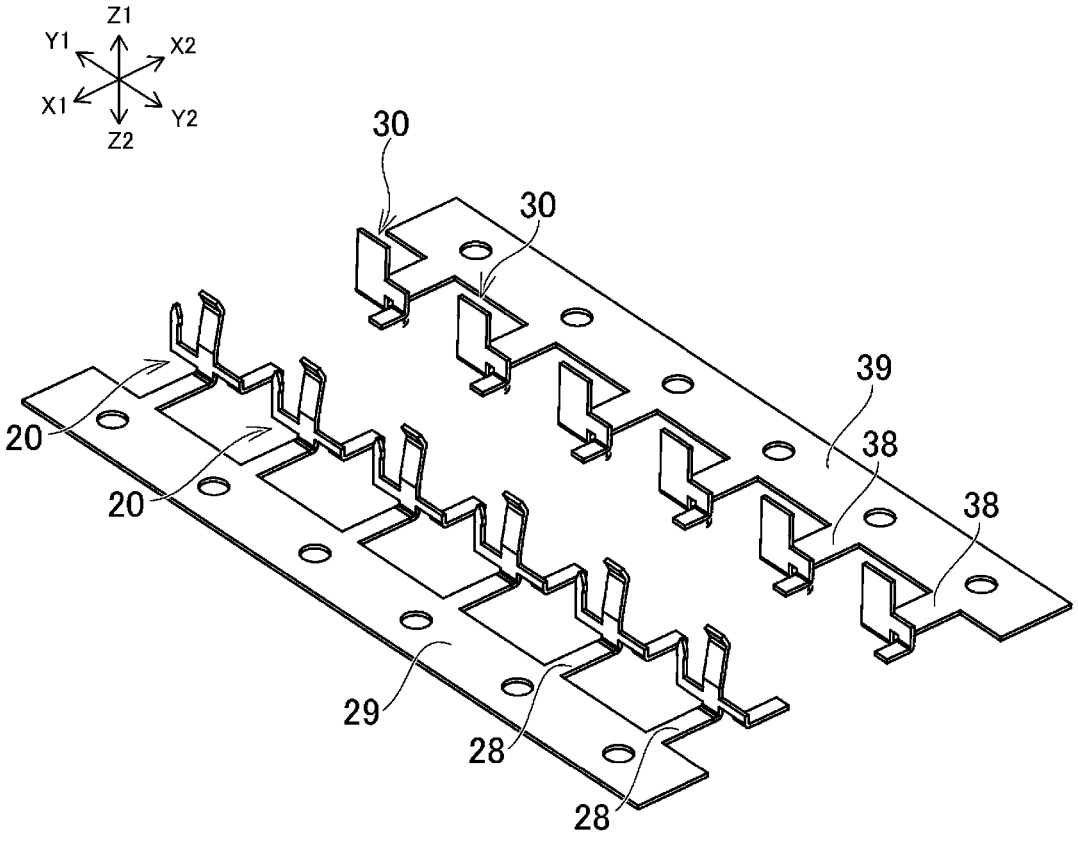
FIG. 7A is a view for describing a method for manufacturing the waveguide illustrated in FIG. 1.

An example of a method for manufacturing the waveguide 10 will be described. As illustrated in FIG. 7A, the plurality of first fittings 20 coupled by the coupling portion 29 with the respective extending portions 28 are prepared. The coupling portion 29 is generally a carrier, and the fittings 20 are continuously formed by a pressing step. Similarly, the plurality of second fittings 30 coupled by the coupling portion 39 with the respective extending portions 38 are prepared. The coupling portion 39 is also a carrier, and the fittings 30 are continuously formed by a pressing step.

Figure 7B:
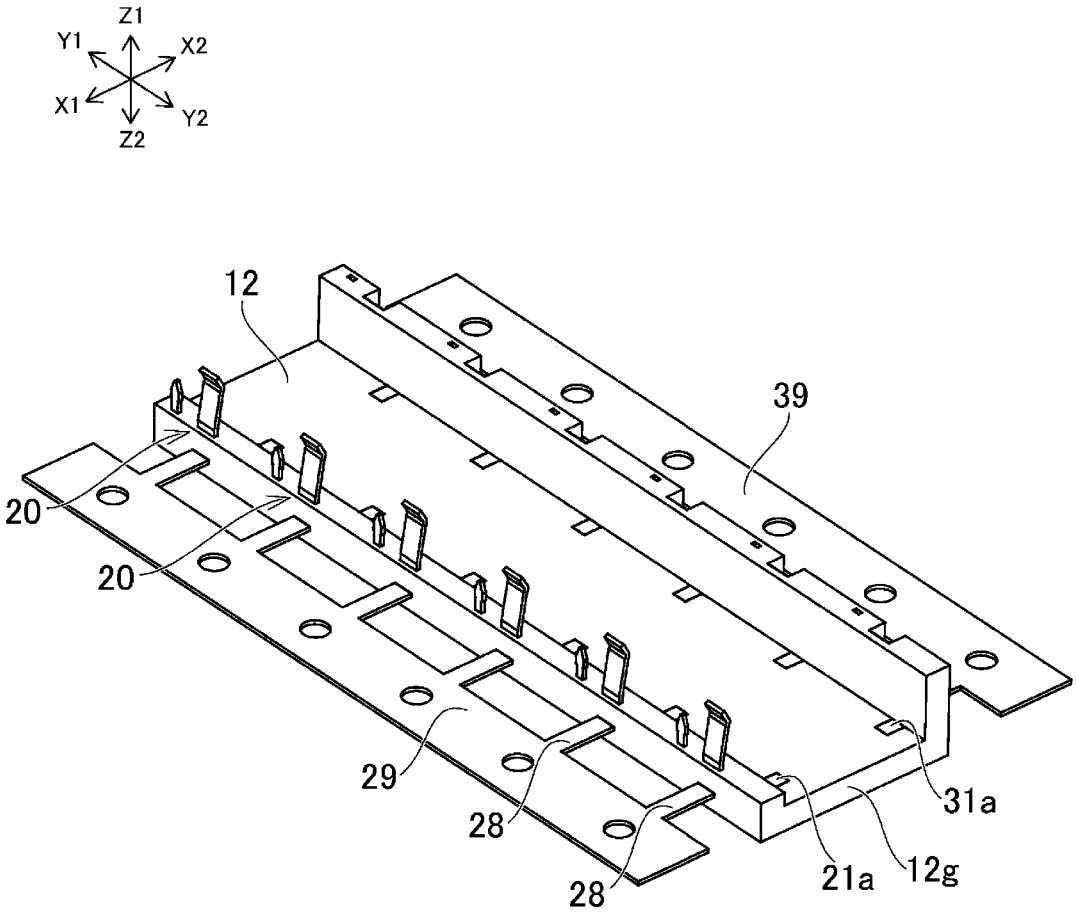
FIG. 7B is a view for describing the method for manufacturing the waveguide illustrated in FIG. 1.

Next, as illustrated in FIG. 7B, the fittings 20 and 30 and the resin portion 12 are integrated by insert molding. In other words, the fittings 20 and 30 are mounted in a mold for molding the resin portion 12, and a resin is injected into the mold to integrate the fittings 20 and 30 and the resin portion 12. At this time, the exposed surfaces 21*a* and 31*a* of the inner exposed portions 21 and 31 are exposed on the inner surface of the resin portion 12. Furthermore, the extending portions 28 and 38 and the coupling portion 29 and 39 protrude from the resin portion 12.

Figure 7C:
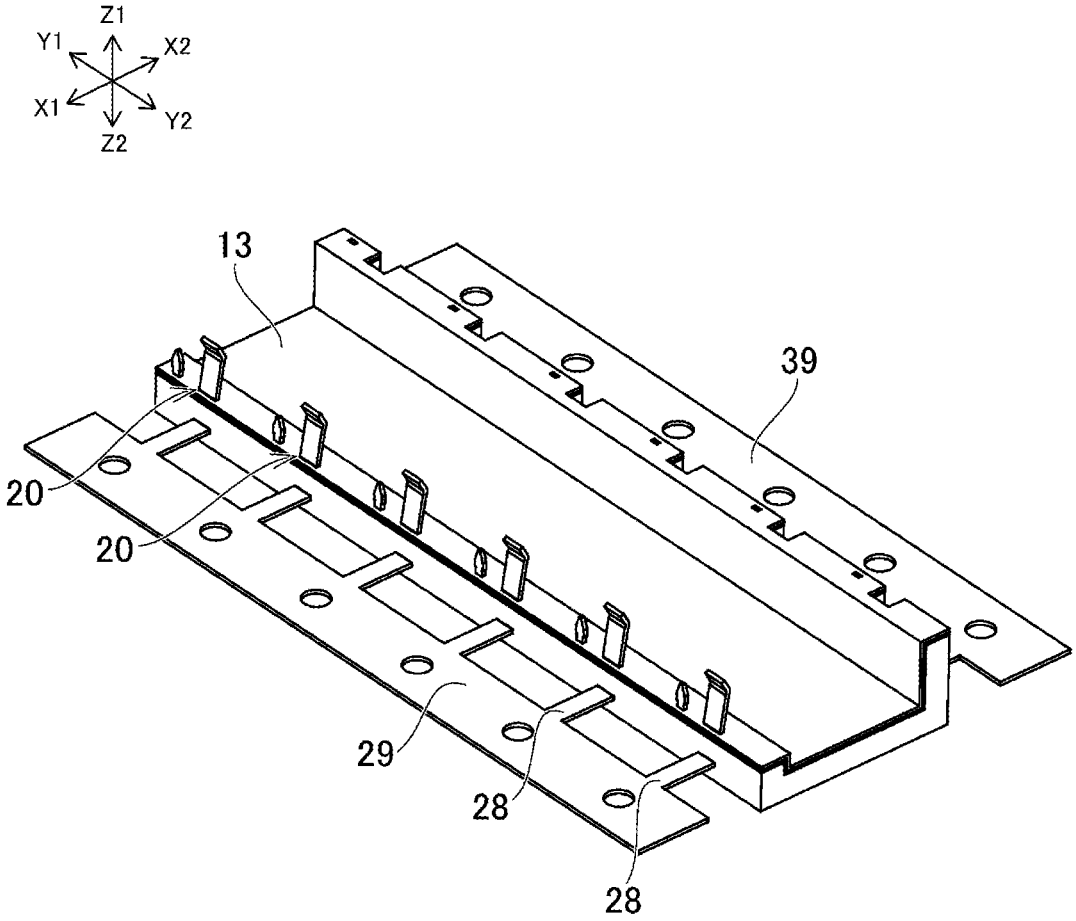
FIG. 7C is a view illustrating the method for manufacturing the waveguide illustrated in FIG. 1.

Next, as illustrated in FIG. 7C, the conductor layer 13 is formed on the inner surface of the resin portion 12. Specifically, an ink or paste electrically-conductive material is applied to the inner surface of the resin portion 12 to form the first conductor layer 13A. This brings the first conductor layer 13A into contact with the inner exposed portions 21 and 31. Examples of the electrically-conductive material include ink (or paste) of silver, copper, zinc oxide, and the like. The first conductor layer 13A may be also applied to the opposed surfaces 12*e* and 12*f* of the side portions 12*b* and 12*c* of the resin portion 12.

Prior to application of the electrically-conductive material, the inner surface of the resin portion 12 may be roughened. For example, laser processing, blasting, UV irradiation, and plasma treatment may be used for roughening. Roughening may improve the adhesiveness between the conductor layer 13 and the surface of the resin portion 12. Furthermore, by roughening the inner surface of the resin portion 12, when the electrically-conductive material that becomes the first conductor layer 13A is applied, the first conductor layer 13A may be uniformly spread on the inner surface of the resin portion 12.

After forming of the first conductor layer 13A, a plating layer is formed on the first conductor layer 13A as the second conductor layer 13B by electrolytic plating step. At this time, the electric potential applied to the fittings 20 and 30 is set such that the fittings 20 and 30 and the first conductor layer 13A function as cathode electrodes. Since the fittings 20 are integrally formed with the extending portions 28 and the coupling portion 29, the plurality of fittings 20 may be simultaneously energized by energizing of the coupling portion 29. Similarly, since the fittings 30 are integrally formed with the extending portions 38 and the coupling portion 39, the plurality of fittings 30 may be simultaneously energized by energizing of the coupling portion 39.

Next, as illustrated in FIG. 3, the extending portions 28 are cut on the outer surface of the resin portion 12. Similarly, the extending portions 38 are cut on the outer surface of the resin portion 12.

The tube member 11 is thereby obtained. Then, another tube member 11 is manufactured by the method described above, and the two tube members 11 are combined with each other in the vertical direction as illustrated in FIG. 2. The waveguide 10 is manufactured in this manner.

The method for manufacturing the waveguide 10 is not limited to the example described with reference to FIGS. 3 and 7A to 7C. For example, in the example illustrated in FIG. 7B, the extending portions 28 and 38 and the coupling portions 29 and 39 protrude from the outer surfaces of the side portions 12*b* and 12*c* of the resin portion 12. However, the plurality of fittings 20 or the plurality of fittings 30 may be coupled to each other inside the resin portion 12, and one extending portion 29 or 39 may protrude from an end surface 12*g* (see FIG. 7B) in the extending direction of the resin portion 12. In this case, in the electrolytic plating step, an electric potential may be applied to the first conductor layer 13A through the protruding portion.

As yet another example, insert molding may not be utilized. After the resin portion 12 is formed, the fittings 20 and 30 may be press-fitted into respective holes formed in the resin portion 12.

With reference to FIGS. 8, 9, 10A, 10B, 11 and 12, a modified example of the waveguide 10 will be described. These drawings illustrate the modified example of a waveguide 110. Hereinafter, differences between the waveguide 10 and the waveguide 110 will be mainly described. The structure described in waveguide 10 may be applied to portions in the waveguide 110 indicated by the same reference numerals as the portions in the waveguide 10, which are not described herein.

The waveguide 110 differs from the waveguide 10 in the structure of the fitting. In the waveguide 110, each of the two tube members 11 includes a first fitting 120 (see FIG. 10A) and a second fitting 130 (see FIG. 10B).

Also in the example of the waveguide 110, the two tube members 11 have the same structure, and the first fitting 120 of the first tube member 11A is electrically connected to the second fitting 130 of the second tube member 11B, and the second fitting 130 of the first tube member 11A is electrically connected to the first fitting 120 of the second tube member 11B. The first fitting 120 has a first connecting portion 122 (see FIG. 10A), and the second fitting 130 has a second connecting portion 132 (see FIG. 10B).

The first connecting portion 122 of the first fitting 120 of one tube member 11 and the second connecting portion 132 of the second fitting 130 of the other tube member 11 are electrically connected to and engaged with each other to restrain the separation of the two tube members 11. In this way, since the two tube members 11 engage with each other at the connecting portions 122 and 132, unlike the first fitting 20 described above, the first fitting 120 does not include the engaging portion 23. Further, the resin member 12 has no engaged portion 12*h*.

Figure 9:
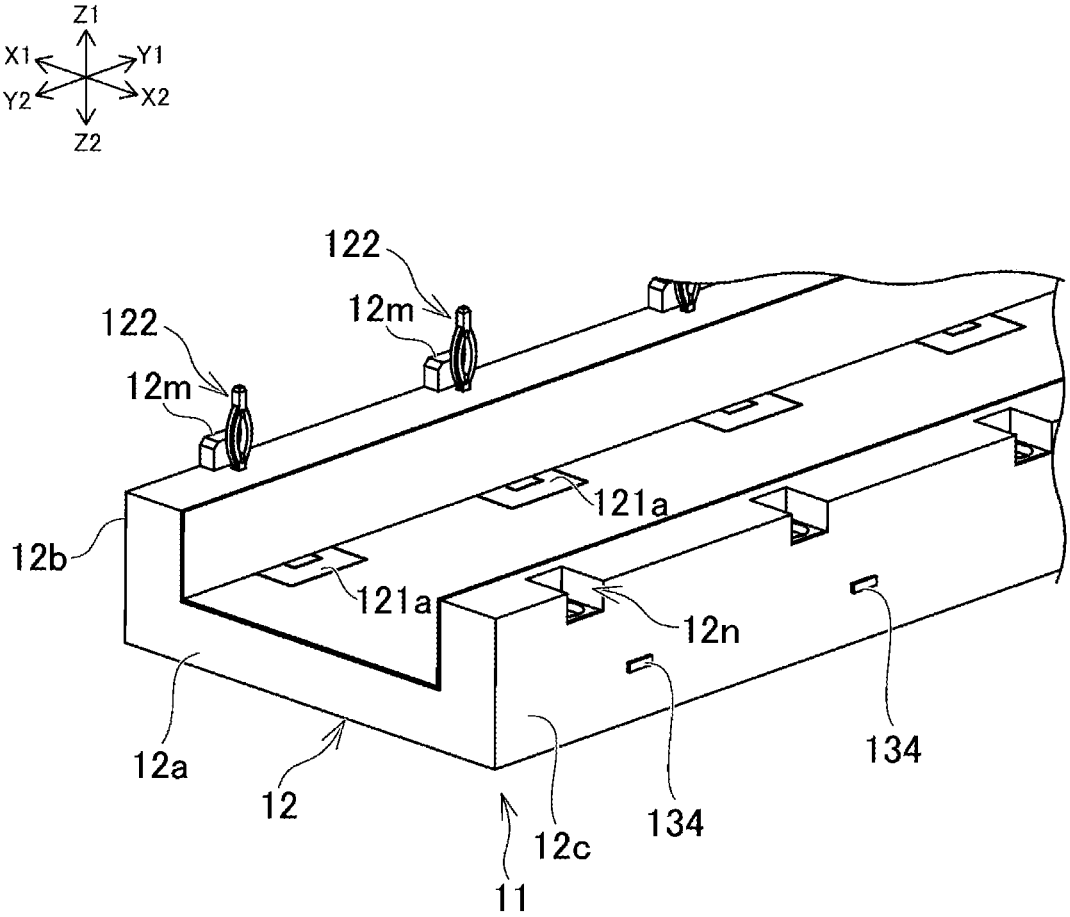
FIG. 9 is a perspective view illustrating one of tube members constituting the waveguide illustrated in FIG. 8. In this drawing, a conductor layer formed on an inner surface of the waveguide is not depicted.
Figure 10A:
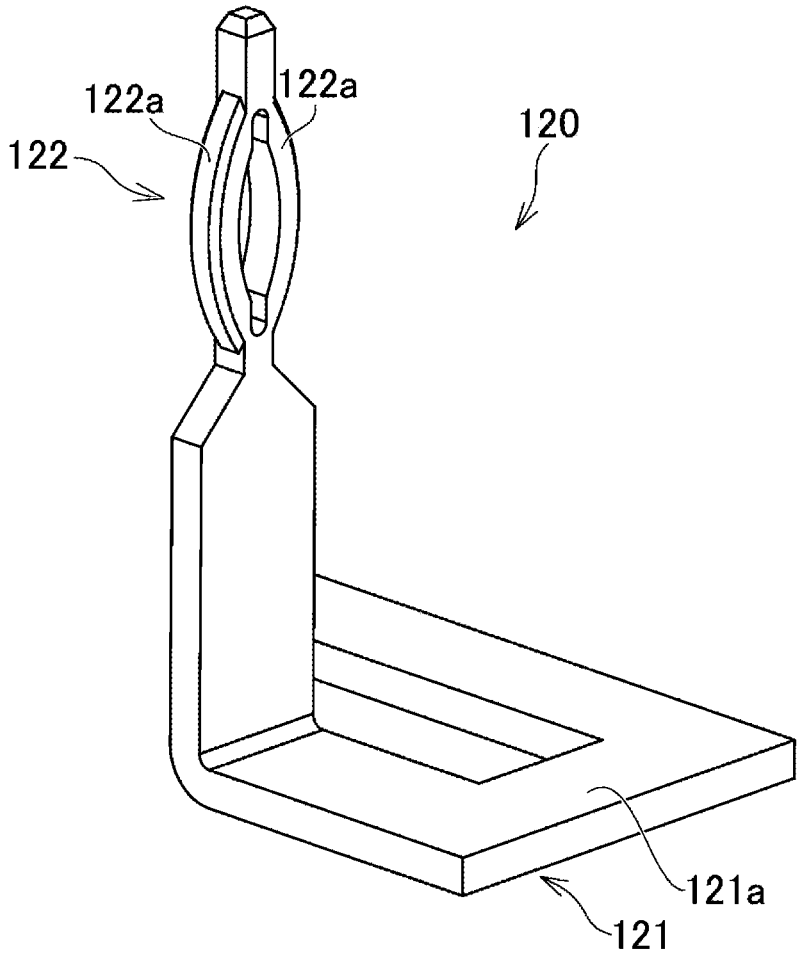
FIG. 10A is a view illustrating another example of the first fitting.
Figure 10B:
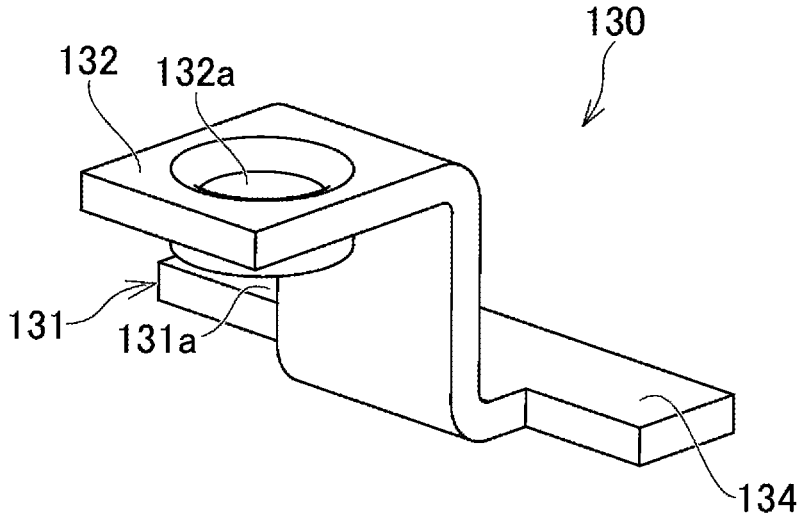
FIG. 10B is a drawing illustrating another example of the second fitting.

As illustrated in FIG. 9, the first connecting portion 122 protrudes from the first side portion 12*b* of the resin portion 12 in the direction in which the two tube members 11 are combined. The first connecting portion 122 has two elastic portions 122*a* (see FIG. 10A). Upper ends of the two elastic portions 122*a* are connected to each other, and the lower ends of the two elastic portions 122*a* are also connected to each other. The middle portions of the two elastic portions 122*a* are separated from each other, and the middle portions are elastically deformable so as to be brought closer to or farther away from each other. Meanwhile, a hole 132*a* (see FIG. 10B) penetrates the second connecting portion 132 of the second fitting 130 in the direction (opposed direction) in which the two tube members 11 are combined.

Figure 11:
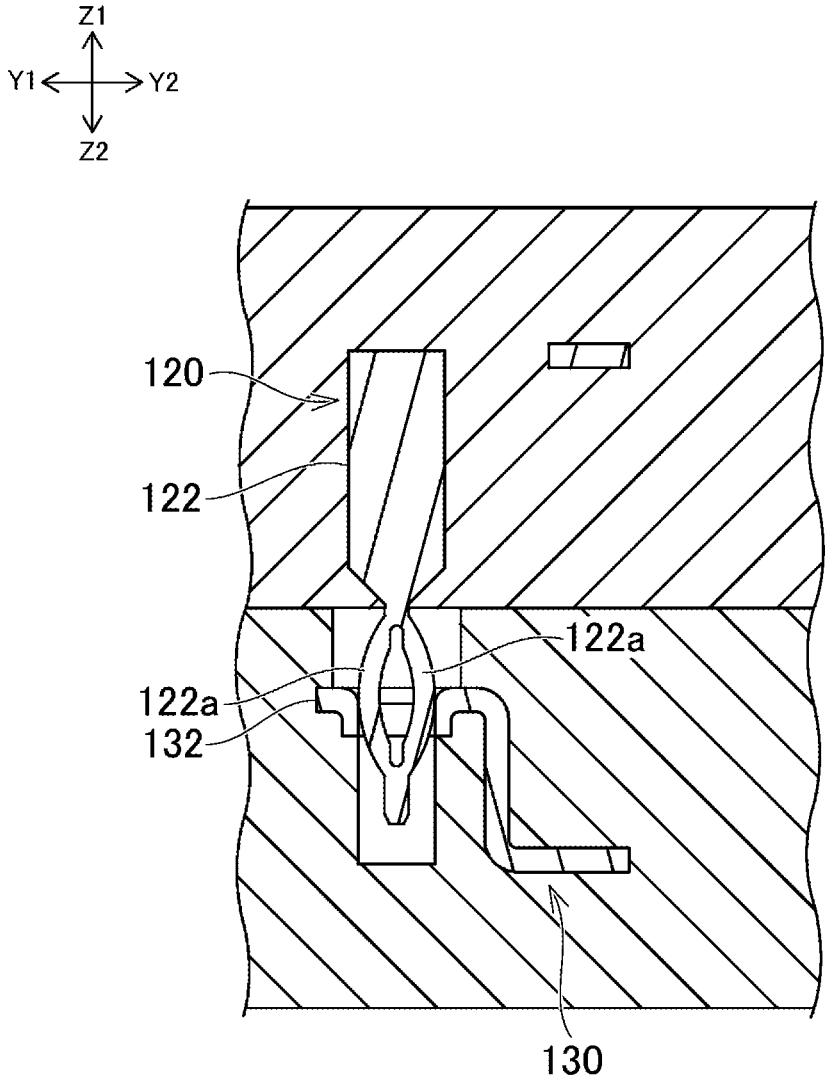
FIG. 11 is a cross-sectional view illustrating the state where two fittings are engaged with each other.
Figure 12:
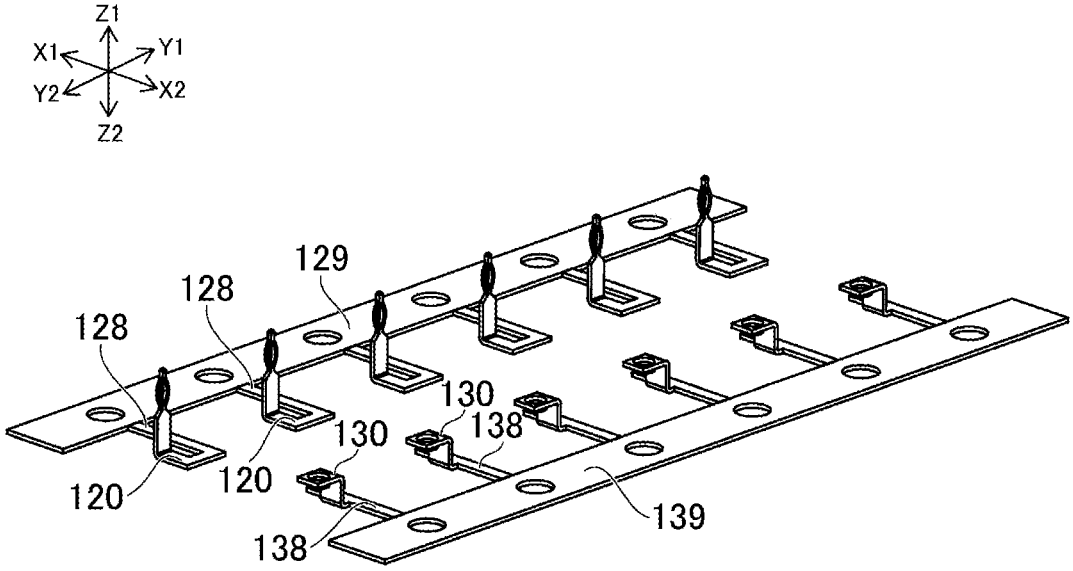
FIG. 12 is a view illustrating a method for manufacturing the waveguide illustrated in FIG. 8.

With the two tube members 11 combined, the two elastic portions 122*a* of the first connecting portion 122 are fitted inside a hole of the second connecting portion 132 as illustrated in FIG. 11. At this time, the two elastic portions 122*a* elastically deform in opposite directions, and are pressed against the inner side of the hole 132*a* of the second connecting portion 132 due to their elastic forces. In other words, the second connecting portion 132 sandwiches the two elastic portions 122*a*. As a result, the two connecting portions 122 and 132 are electrically connected to each other and restrained their separation.

Figure 8:
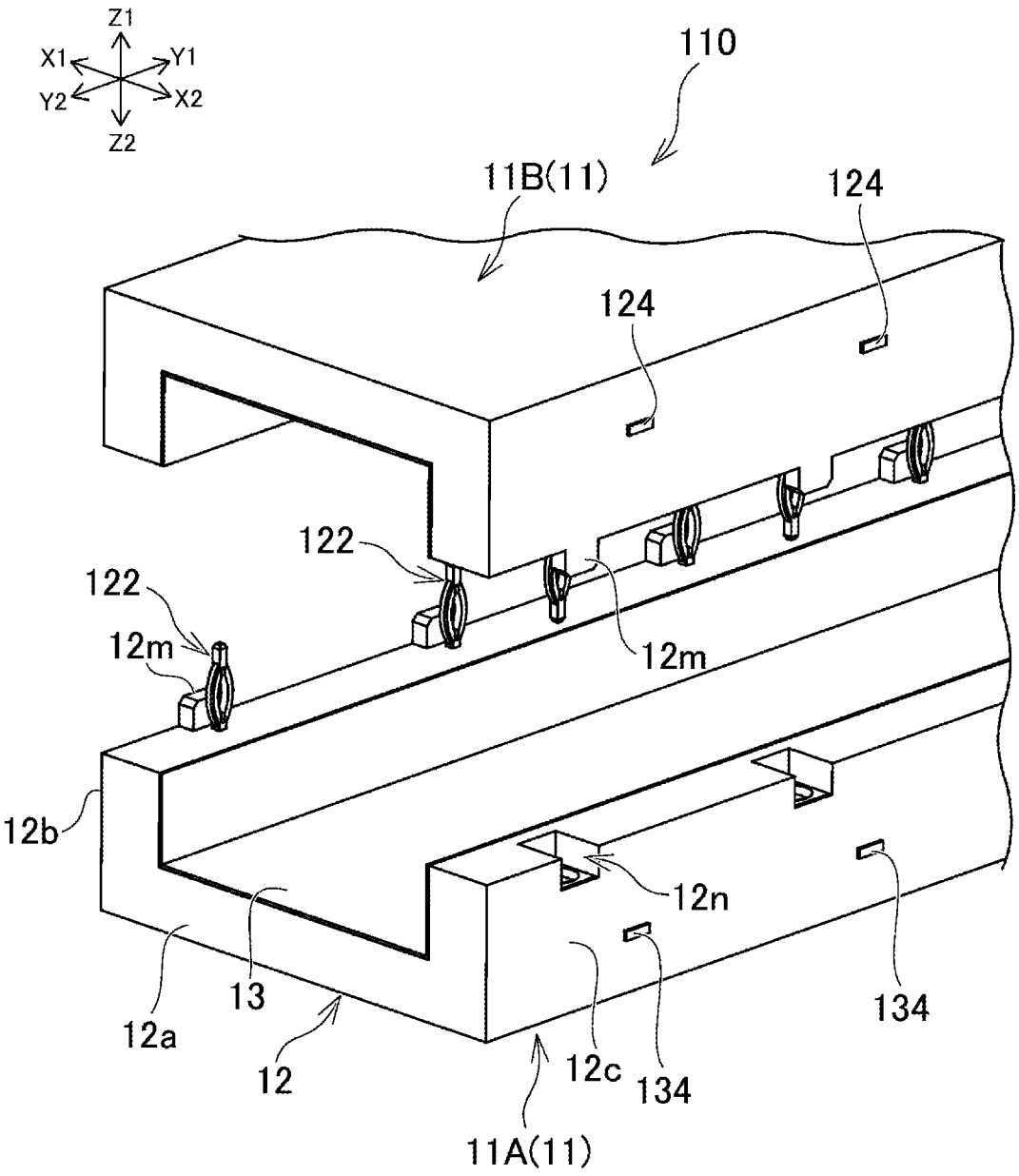
FIG. 8 is an exploded perspective view illustrating another example of the waveguide proposed in the present disclosure.

In addition, in the example of the waveguide 110, the resin portions 12 of the two tube members 11 also mate with each other. In more detail, as illustrated in FIGS. 8 and 9, a convex portion 12*m* is formed on the opposed surface 12*e* of the first side portion 12*b*, and a concave portion 12*n* may be formed on the opposed surface 12*f* of the second side portion 12*c*. When the two tube members 11 are combined, the convex portion 12*n* of one tube member 11 fits into the concave portion 12*n* of the other tube member 11.

Further, the first fitting 120 has a first inner exposed portion 121 (see FIG. 10) and an energizing portion 124 (see FIG. 8). The first inner exposed portion 121 has an exposed surface 121*a* that is not covered with the material for the resin portion 12. The effects of the exposed surface 121*a* and the energizing portion 124 are the same as those of the exposed surface 21*a* of the first inner exposed portion 21 and the energizing portion 24. The first fitting 120 is coupled to a coupling portion 129 with extending portions 128 in the state where the extending portions 128 have not yet been cut in the manufacturing process of the tube member 11 (see FIG. 12).

The second fitting 130 has a second inner exposed portion 131 (see FIG. 10B) and an energizing portion 134 (see FIG. 8). Additionally, the second inner exposed portion 131 has an exposed surface 131*a* (FIG. 10B) that is not covered with the material for the resin portion 12. The effects of the exposed surface 131*a* and the energizing portion 134 are the same as those of the exposed surface 31*a* of the second inner exposed portion 31 and the energizing portion 34. The second fitting 130 is coupled to a coupling portion 139 with extending portions 138 in the state where the extending portions 138 have not yet been cut in the manufacturing process of the tube member 11 (see FIG. 12).

The method for manufacturing the waveguide 110 is basically the same as the method for manufacturing the waveguide 10 described with reference to FIGS. 3 and 7A to 7C. The difference between the waveguide and the waveguide 10 is that when the two tube members 11 are combined in the vertical direction, the first fitting 120 and the second fitting 130 are electrically connected to and engaged with each other with the first connecting portion 122 and the second connecting portion 132. In other words, in the example of the waveguide 10, the electrical connection between the fitting 20 and the fitting 30 and the coupling between the tube members 11 are performed with different configurations, while in the example of the waveguide 110, the electrical connection between the fitting 20 and the fitting 30 and the coupling between the tube members 11 are simultaneously performed with the first connecting portion 122 and the second connecting portion 132.

Second Modified Example

Figure 13:
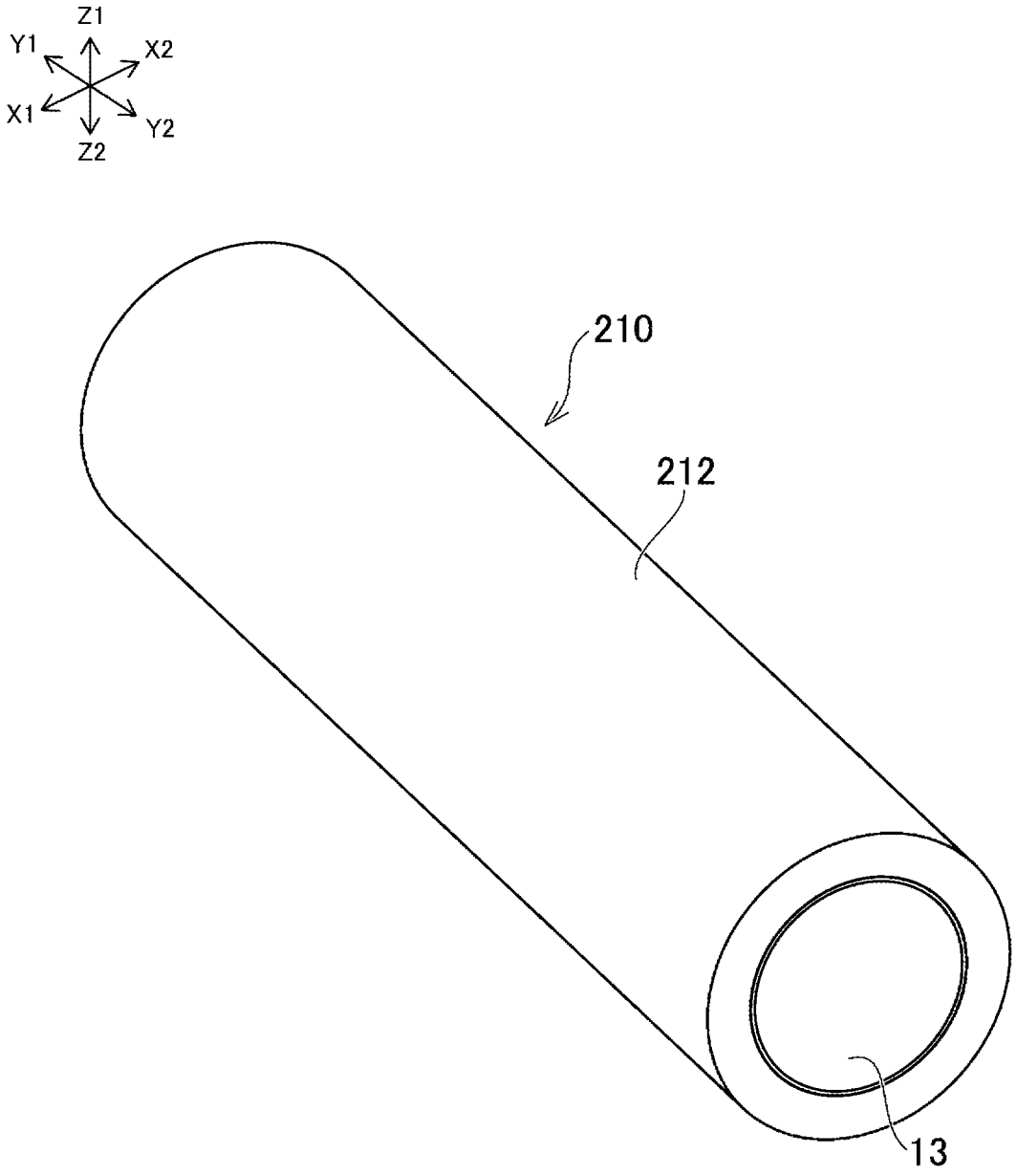
FIG. 13 is a perspective view illustrating another example of the waveguide proposed in the present disclosure.
Figure 14:
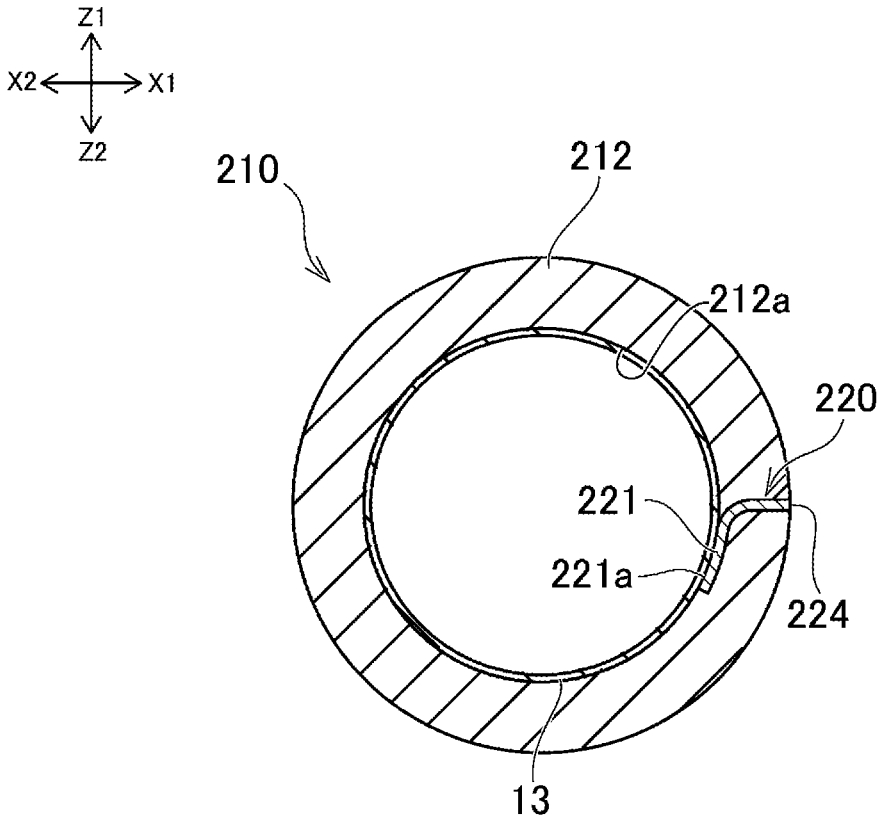
FIG. 14 is a cross-sectional view of the waveguide illustrated in FIG. 13.
Figure 15A:
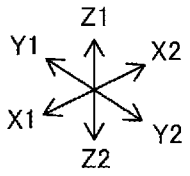
FIG. 15A is a view illustrating a method for manufacturing the waveguide illustrated in FIG. 13.
Figure 15A:
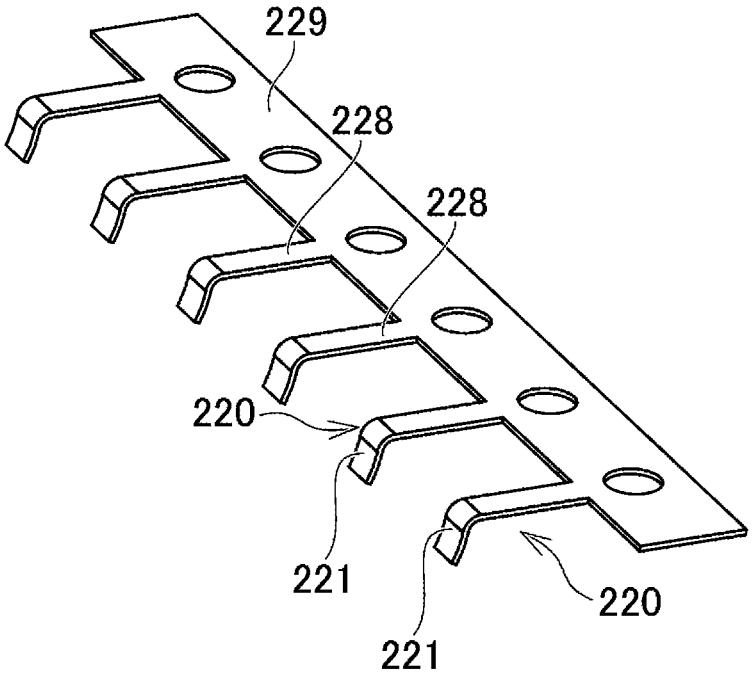
Figure 15B:
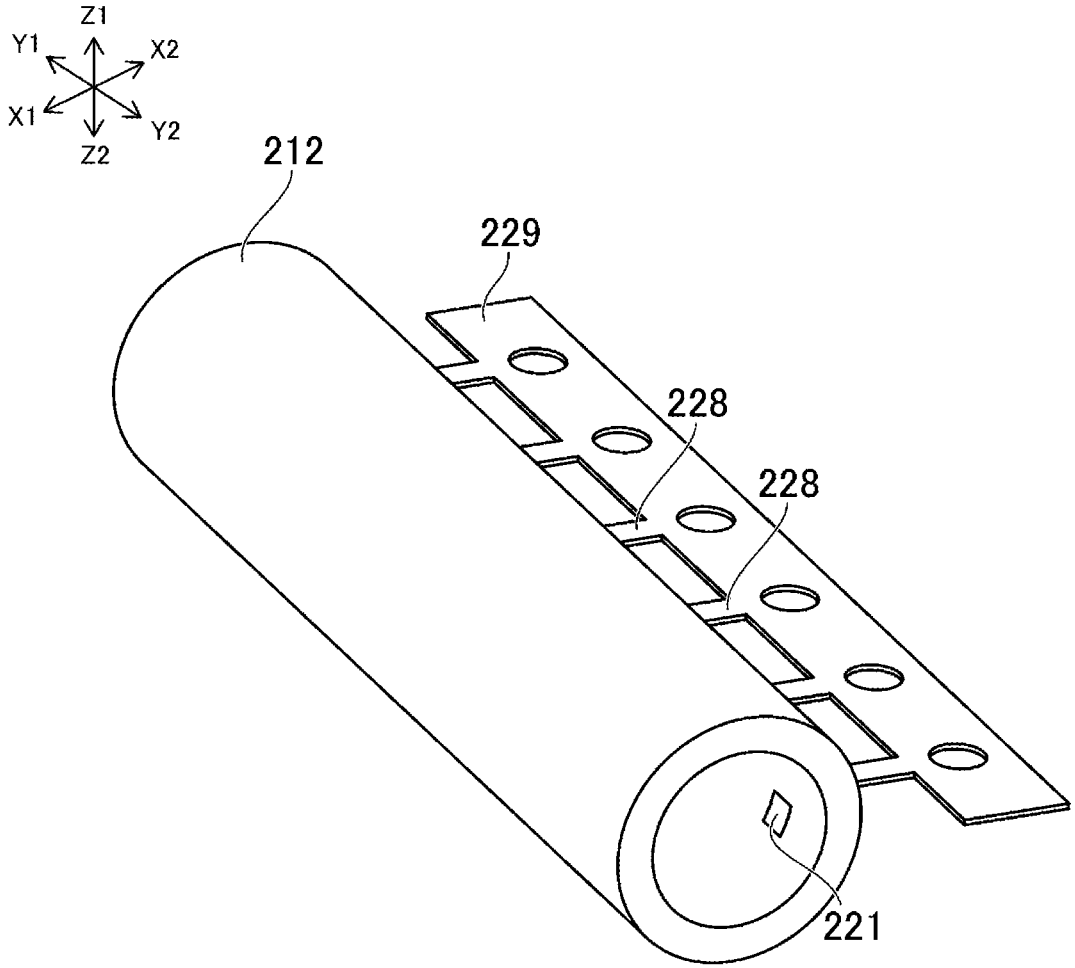
FIG. 15B is a view illustrating a method for manufacturing the waveguide illustrated in FIG. 13.

As described above, the waveguides 10 and 110 each are configured of the two tube members combined in the direction orthogonal to the extending direction thereof. However, the entire waveguide may be integrally formed. FIGS. 13 and 14 are views illustrating a waveguide 210, which is an example of a waveguide of such structure. FIGS. 15A and 15B are views illustrating an examples of a method for manufacturing the waveguide 210. Hereinafter, differences between the waveguide 10 and the waveguide 210 as illustrated in FIGS. 13 and 14 will be described. The structure described in waveguide 10 may be applied to parts in the waveguide 210, which are not described herein.

The waveguide 210 illustrated in FIGS. 13 and 14 includes a tubular resin portion 212. Unlike the resin portion of the waveguide 10, the resin portion 212 is integrally formed. In other words, the resin portion 212 is continuous over the entire periphery of the waveguide 210. The resin portion 212 is cylindrical, but may be a quadrangular prism. Further, the resin portion 212 may be straight in the extending direction or may be curved.

As illustrated in FIG. 14, the fitting 220 includes an inner exposed portion 221 that is located on the inner surface of the resin portion 212 and is not covered with the material for the resin portion 212. An exposed surface 221*a*, which is not covered with a resin of the inner exposed portion 221, is covered with the conductor layer 13 and is in contact with the conductor layer 13. Specifically, the exposed surface 221*a* is in contact with the first conductor layer 13A made of an ink or paste electrically-conductive material. Like the fittings 20 and 30 described above, the fitting 220 is formed of a metal plate. The exposed surface 221*a* of the inner exposed portion 221 is one surface of the metal plate. Further, like the fittings 20 and 30, the fitting 220 includes an energizing portion 224 exposed at the outer peripheral surface of the resin portion 212 (see FIG. 14).

In the example of the waveguide 210, the cross section of the resin portion 212 is annular. Therefore, the resin portion 212 is curved in an arc shape so as to conform to the inner surface 212*a* of the resin portion 212. That is, the resin portion 212 has a portion surrounding the inner exposed portion 221, and the exposed surface 221*a* is flush with the inner surface 212*a* of the resin portion 212. This may form the conductor layer 13 having uniform thickness.

The waveguide 210 may have a plurality of resin portions 212. For example, the waveguide 210 may have the plurality of resin portions 212 aligned in the extending direction of the waveguide 210. In yet another example, the waveguide 210 may include the plurality of resin portions 212 spaced at intervals in the circumferential direction of the waveguide 210.

An example of a method for manufacturing the waveguide 210 will be described below. The method for manufacturing the waveguide 210 is basically the same as the method for manufacturing the waveguide 10 described with reference to FIGS. 3 and 7A to 7C. In other words, as illustrated in FIG. 15A, a plurality of fittings 220 are provided that are coupled by a coupling portion 229 with respective extending portions 228. As illustrated in FIG. 15B, the fittings 220 and the resin portion 212 are integrated by insert molding. In other words, the fittings 220 are inserted into a mold for molding the resin portion 212, and a resin is injected into the mold to integrate the fittings 220 and the resin portion 212. At this time, the exposed surface 221A of the inner exposed portion 221 is exposed on the inner surface 212*a* of the resin portion 212. Further, the extending portions 228 and the coupling portion 229 protrude from the resin portion 212.

Next, after roughening the inner surface 212*a* of the resin portion 212, the conductor layer 13 is formed on the inner surface 212*a*. Specifically, an ink or paste electrically-conductive material is applied to the inner surface 212*a* to form the first conductor layer 13A. Thereafter, the plating layer that is the second conductor layer 13B is formed on the first conductor layer 13A by the electrolytic plating step. In the electrolytic plating step, a rod-shaped anode electrode may be inserted inside the resin portion 212. After the second conductor layer 13B is formed, the extending portions 228 of the metal plate 220A are cut at the outer surface of the resin portion 212. This results in a tube member 210.

As described above, the waveguides 10, 110, and 210 include tubular resin portions 12 and 212 made of a resin, the conductor layer 13 formed on inner surfaces of the resin portions 12 and 212, and at least one of fittings 20, 30, 120, 130, and 220 held by the resin portions 12 and 212. The fittings 20, 30, 120, 130, and 220 have the respective inner exposed portions 21, 31, 121, 132, and 221 that are not covered with a resin that is a material for the resin portions 12 and 212. The conductor layer 13 covers the inner exposed portions 21, 31, 121, 132, and 221 and is in contact with the inner exposed portions 21, 31, 121, 132, and 221. With this structure, the conductor layer 13 may be easily formed by the electrolytic plating step.

Further, the plurality of inner exposed portions 21, 31, 121, 132, and 221 separated from each other are provided in each of the waveguides 10, 110, and 210. More specifically, the plurality of inner exposed portions 21, 121, and 221 are arranged at intervals in the extending direction of the waveguides 10, 110, and 210, respectively. Further, the plurality of inner exposed portions 31 and 131 are arranged at intervals in the extending direction of the waveguides 10 and 110, respectively. Further, the inner exposed portion 21 and 121 are separated from the inner exposed portion 31 and 131, respectively, in the width direction of the waveguides 10 and 110. With this structure, when the second conductor layer 13B is formed in the electrolytic plating step, the electric potential of the first conductor layer 13A can be prevented from becoming uneven to reduce the unevenness of the thickness of the second conductor layer 13B.

The waveguides 10 and 110 each include the two tube members 11. Each of the two tube members 11 includes the conductor layer 13 formed on the inner surface of the resin portion 12, and the fittings 20 and 30 that are held by the resin portion 12 and have the inner exposed portions 21 and 31 connected to the conductor layer 13. Moreover, the fittings 20 and 30 of one tube member 11 and the fittings 30 and 40 of the other tube member 11 are connected to each other. In this manner, an offset between the electrical potentials of the conductor layers 13 of the two tube members 11 may be reduced.

The waveguide proposed in the present disclosure is not limited to the structures of the waveguides 10, 110, and 210 described above.

For example, each of the fittings 20 may have a plurality of inner exposed portions 21. Similarly, the fittings 30, 120, 130, and 220 may have a plurality of inner exposed portions 31, 121, 132, and 221 aligned in the extending direction of the waveguides 10, 110, and 210, respectively.

The exposed surfaces 21*a* and 31*a* of the inner exposed portions 21 and 31 are not necessarily formed on the inner surface of the resin portion 12. For example, the exposed surfaces 21*a* and 31*a* may be positioned on the opposed surfaces 12*e* and 12*f* of the side portions 12*b* and 12*c* of the resin portion 12, and may be in contact with the first conductor layer 13A. Similarly, in the waveguide 110, unlike with the exposed surface waveguides 10 and 110, the two tube members 11 may have different structures.

For example, as long as the resin portion 12 included in the first tube member 11A and the resin portion 12 of the second tube member 11B are combined to form a tubular structure, the structures of the tube members may be different from each other. As yet another structure, the resin portions 12 of the two tube members 11 have the same structure, but may be different in the shape of the fittings 20 and 30.

In the waveguide 10, the two tube members 11 are fixed with the engaging portion 23 and the engaged portion 12*h*. However, the waveguide 10 may have a member that secures the two tube members 11 (for example, a band that is wound outside of the tube member 11).

The waveguide 10 includes the two kinds of fittings 20 and 30. Similarly, the waveguide 110 includes the two kinds of fittings 120 and 130. However, one type of fitting may be used.

The conductor layer 13 includes the first conductor layer 13A and the second conductor layer 13B. However, the conductor layer 13 has not necessarily a two-layer structure. For example, the conductor layer 13 may be constituted of only the first conductor layer 13A formed by applying an ink or paste electrically-conductive material to the inner surface of the resin portion 12. As another example, in the manufacturing steps for the waveguide, the ink or paste electrically-conductive material (for example, copper) may be the same as the material for the plating layer formed in the electrolytic plating step. In this case, the conductor layer 13 is one layer made of that material.

The number of tube members 11 that constitute the waveguide 10 may be more than two. For example, three or four tube members may be combined in the direction orthogonal to the extending direction of the waveguide to form a single waveguide.

The invention claimed is:

1. A waveguide comprising:

a tubular resin portion made of resin;

a conductor layer formed on an inner surface of the resin portion; and at least one fitting held by the resin portion; wherein:

the at least one fitting has at least one exposed surface that is not covered with the resin portion and at least one energizing portion electrically connected to the at least one exposed surface; and the conductor layer covers the at least one exposed surface and is in contact with the at least one exposed surface.

2. The waveguide according to claim 1, wherein the at least one exposed surface includes a plurality of exposed surfaces spaced from each other.

3. The waveguide according to claim 2, wherein the plurality of exposed surfaces are spaced at intervals in an extending direction of the waveguide.

4. The waveguide according to claim 1, wherein the at least one exposed surface is exposed to be flush with an inner surface of the resin portion.

5. The waveguide according to claim 1, wherein the tubular resin portion comprises a first tube member and a second tube member that are combined with each other in a direction orthogonal to the extending direction of the waveguide to form the tubular resin portion.

6. The waveguide according to claim 5, wherein the at least one fitting includes at least one fitting provided on the first tube member and at least one fitting provided on the second tube member, and the at least one fitting provided on the first tube member is electrically connected to the at least one fitting provided on the second tube member.

7. A method for manufacturing a waveguide, the method comprising:

preparing at least one fitting;

forming a resin portion for holding the at least one fitting, the resin portion holding the at least one fitting such that an exposed surface of the at least one fitting that is not covered with the resin portion is located on an inner surface of the resin portion;

forming a first conductor layer made of an ink or paste electrically-conductive material on the inner surface of the resin portion, covering the exposed surface of the at least one fitting with the first conductor layer, and connecting the exposed surface of the at least one fitting to the first conductor layer; and forming a conductor layer on the inner surface by electrolytic plating using the at least one fitting and the first conductor layer as electrodes.

8. The method for manufacturing the waveguide according to claim 7, wherein the at least one fitting includes a plurality of fittings that are integrally coupled.

9. The method for manufacturing the waveguide according to claim 7, wherein the inner surface of the resin portion is roughened, and then the first conductor layer is formed on the inner surface of the resin portion.

* * * * *